US007896489B2

(12) United States Patent
Tanabe

(10) Patent No.: US 7,896,489 B2
(45) Date of Patent: Mar. 1, 2011

(54) IMAGE RECORDING APPARATUS

(75) Inventor: Tsuyoshi Tanabe, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 1154 days.

(21) Appl. No.: 11/591,523

(22) Filed: Nov. 2, 2006

(65) Prior Publication Data

US 2007/0109387 A1 May 17, 2007

(30) Foreign Application Priority Data

Nov. 2, 2005 (JP) ..... 2005-319535
Dec. 1, 2005 (JP) ..... 2005-347590
Dec. 19, 2005 (JP) ..... 2005-364910

(51) Int. Cl.
*B41J 2/01* (2006.01)
*B41J 29/38* (2006.01)

(52) U.S. Cl. ..... 347/104; 347/101; 347/16

(58) Field of Classification Search ..... 347/104, 347/101, 16
See application file for complete search history.

(56) References Cited

U.S. PATENT DOCUMENTS 3,334,722 A * 8/1967 Bernard ..... 400/616.1
3,399,884 A * 9/1968 Bahrani ..... 270/52.08
4,457,507 A * 7/1984 Ishikawa et al. ..... 271/121
4,838,535 A * 6/1989 Yokoi et al. ..... 271/22
5,546,178 A * 8/1996 Manzer et al. ..... 399/384
5,659,875 A * 8/1997 Manzer et al. ..... 399/384
5,940,106 A * 8/1999 Walker ..... 347/104
6,039,481 A * 3/2000 Ham ..... 400/708
6,615,717 B1 * 9/2003 Perdu ..... 101/223
6,733,109 B1 * 5/2004 Lorenz et al. ..... 347/36
6,832,833 B2 * 12/2004 Tsuji et al. ..... 347/104
6,945,528 B2 * 9/2005 Nakamura ..... 271/171
7,021,756 B2 * 4/2006 Nakashima et al. ..... 347/104
7,285,965 B2 * 10/2007 Shen et al. ..... 324/716
2003/0179273 A1 9/2003 Tsuji et al.

FOREIGN PATENT DOCUMENTS

JP 05-229699 A 9/1993
JP 2002-027226 A 1/2002
JP 2003-260839 A 9/2003
JP 2003-261249 A 9/2003

OTHER PUBLICATIONS

JP Communication, dated Feb. 2, 2010, issued in corresponding JP Application No. 2005-319535, 3 pages in English (partial translation) and Japanese.

* cited by examiner

*Primary Examiner*—Stephen D Meier
*Assistant Examiner*—Leonard S Liang
(74) *Attorney, Agent, or Firm*—Sughrue Mion, PLLC

(57) ABSTRACT

The image recording apparatus includes a regulating guide for regulating a position of a recording medium and a passage changing unit for changing a passage of the recording medium to the other passage thereof. The regulating guide includes a pair of outer guides arranged at outermost positions in a width direction and having in a perpendicular direction to a transport plane for the recording medium plural outer passage portions for regulating a position of the recording medium in the width direction and at least one inner guide arranged between the pair of outer guides and having on both sides in the width direction inner passage portions for regulating a position of the recording medium in the width direction at a position in the perpendicular direction corresponding to one outer passage portion of the pair of outer guides. The regulating guide forms plural passages in the perpendicular direction.

14 Claims, 14 Drawing Sheets

IMAGE RECORDING APPARATUS

The entire contents of literatures cited in this specification are incorporated herein by reference.

BACKGROUND OF THE INVENTION

The present invention belongs to the technical field of an image recording apparatus such as an ink jet printer. In particular, the present invention relates to an image recording apparatus capable of achieving high productivity by transporting recording media in parallel as needed and capable of easily performing switching between parallel transport and single-line transport.

As a method of achieving an enhancement in productivity in various types of image recording apparatus including an ink jet printer, there is known a method in which recording media are transported in a plurality of lines arranged in a direction (hereinafter referred to as the width direction) perpendicular to a recording medium transporting direction (hereinafter referred to as the parallel transport) and in which image recording (drawing) and a post-processing after image recording are performed in this parallel transport state.

It goes without saying that to output proper prints, the recording media must be positioned properly in the width direction at the time of image recording, etc.

For this purpose, there have been proposed various regulating guides for regulating positions of the recording media in the width direction in conformity with the image recording apparatus in which the image recording is to be performed through the parallel transport.

For example, JP 2003-260839 A (hereinafter referred to as Patent Document 1) discloses an image recording apparatus having a regulating guide composed of a fixed guide which has at either end in the width direction a groove for regulating a position of one end (i.e., end in the width direction) of a recording medium and which is fixed to a support plate so as to be situated at the center in the width direction, and two movable guides each of which has a groove for regulating a position of the other end of a recording medium on the inner side in the width direction and which are situated at both sides in the width direction of the fixed guide and movable in the width direction. The regulating guide has the pair of movable guides situated at both sides in the width direction of the fixed guide as two movable guides, and a plurality of mounting portions for mounting the movable guides are arranged side by side in the width direction on the support plate, so that the movable guides are detachable in the width direction.

With this regulating guide, the distance between the movable guides (their positions in the width direction) is adjusted, whereby it is possible to perform the parallel transport of recording media while properly regulating their positions in the width direction in conformity with recording media of various sizes (widths). However, in the image recording apparatus using this regulating guide, it is impossible to perform the image recording through the single-line transport in which the recording media are not arranged in a plurality of lines, so it is impossible to perform the image recording using a large recording medium whose size is in excess of the movable range of the movable guides.

In this connection, JP 2003-261249 A (hereinafter referred to as Patent Document 2) discloses an image recording apparatus having a regulating guide composed of a central guide situated at the center in the width direction and having at either end in the width direction a groove for regulating a position of one end of each recording medium, two movable guides which have on inner sides with respect to the width direction grooves for regulating positions of the other ends of the recording media and which are situated on both sides in the width direction of the central guide and movable in the width direction, and a retreat mechanism which moves the central guide in a direction (hereinafter referred to as the vertical direction) substantially perpendicular to a recording medium transport plane to thereby cause the central guide to retreat from the transport plane where transport is effected along the movable guides.

As in the case of Patent Document 1, with this regulating guide, it is possible to perform the parallel transport in conformity with recording media of various sizes by the central guide and the movable guides. Further, with this regulating guide, by vertically moving the central guide, it is also possible to perform the single-line transport using the movable guides alone.

SUMMARY OF THE INVENTION

However, the regulating guide disclosed in Patent Document 2 can only be applied to two types of transport, that is, the single-line transport and the parallel transport in a fixed number of lines, for example, two lines, resulting in a rather low degree of freedom.

Further, in the regulating guide disclosed in Patent Document 2, it is necessary to provide the retreat mechanism for causing the central guide to retreat completely from the transport plane for the single-line transport, with the result that the image forming apparatus is rather large and complicated. Further, due to its construction, in this regulating guide, the central guide which serves as the positional reference in the width direction for the recording media in the case of the parallel transport is moved in the vertical direction, so the positional accuracy for the central guide in the width direction is rather low due to an error, a margin inevitable in operation, etc. Therefore, there has been a problem in that the requisite positional accuracy for the recording media in the width direction is difficult to attain, which is likely to lead to an improper print output attributable to an error in image recording position, etc.

In addition, in the image recording apparatus as disclosed in Patent Document 1 and Patent Document 2, the central guide used in the parallel transport is fixed in the width direction, so in the case, for example, of the image recording by a so-called full width array (FWA) system in which the image recording is performed by using a line head having a nozzle line (i.e., line of nozzles ejecting ink droplets) longer than the maximum width of the recording medium to be used, unevenness in frequency of use is generated among the nozzles, and there is involved deterioration in the recording elements (i.e., nozzles) of high frequency of use, that is, deterioration in ejection performance due to local degradation of the recording elements, making it impossible to maintain a satisfactory ejection performance for the head as a whole.

Further, in the regulating guide as disclosed in Patent Document 1, it is possible for a user to arrange the movable guides at the positions on the support plate where the mounting portions are arranged through attachment/detachment of the movable guides. However, the movable guides cannot be arranged at other positions. Thus, the width of the transport path of the recording medium can only be set to a predetermined width, which means the degree of freedom in terms of print size is rather low. Further, when changing the width of the transport path, it is necessary for a user to manually move the movable guides, resulting in a rather poor operational efficiency.

Further, with the regulating guide disclosed in Patent Document 2, it is possible to perform the parallel transport in conformity with recording media of various sizes (widths) by the central guide and the pair of movable guides whose positions can be adjusted in the width direction. However, the positions of the movable guides of this regulating guide can only be adjusted symmetrically with respect to the central guide. That is, with this regulating guide, the parallel transport can only be performed on recording media of the same width, which means a rather low degree of freedom in terms of print size in the parallel transport.

It is a first object of the present invention to solve the above-mentioned problems in the conventional techniques and to provide an image recording apparatus which is small and of simple construction, which can be easily applied not only to the single-line transport but also to a plurality of kinds of parallel transport in two lines, three lines, etc., and which can ensure the requisite positional accuracy in the width direction for the recording media in the case of the parallel transport.

It is a second object of the present invention to provide an image forming apparatus which is small and of simple construction, which easily allows switching between the single-line transport and the parallel transport, and which can ensure the requisite positional accuracy in the width direction for the recording media in the case of the parallel transport.

Another object of the present invention is to provide an image recording apparatus in which, when using in particular a line head, the position in the width direction of the transport path for the parallel transport of the recording media (hereinafter referred to as the parallel path) is changed, whereby the frequency of use of each recording element of the head is leveled out, thereby making it possible to maintain a satisfactory image recording performance for the head as a whole.

It is a third object of the present invention to provide an image recording apparatus capable of easily performing the parallel transport on a plurality of recording media of different sizes (widths).

In order to achieve the above first object, a first aspect of the present invention is to provide an image recording apparatus, including:

an image recording section for recording an image on a recording medium;

a loading section for loading the recording medium;

feeding means for feeding the recording medium from the loading section to the image recording section;

a discharging section for discharging the recording medium on which the image has been recorded in the image recording section;

transport means for transporting the recording medium from the loading section to the discharging section;

a regulating guide which is arranged in a transport path for the recording medium transported by the transport means from the loading section to the discharging section and which regulates a position of the recording medium in a width direction perpendicular to a transport direction of the recording medium transported by the transport means, wherein the regulating guide has:

a pair of outer guides arranged at outermost positions in the width direction and having in a direction perpendicular to a transport plane for the recording medium plural outer passage portions for regulating a position of one end portion of the recording medium in the width direction, and at least one inner guide arranged between the pair of outer guides and having on both sides in the width direction inner passage portions for regulating a position of another end portion of the recording medium in the width direction at a position in the direction perpendicular to the transport plane for the recording medium corresponding to one outer passage portion of the pair of outer guides, and wherein the regulating guide forms plural passages in the direction perpendicular to the transport plane for the recording medium, the plural passages including:

a first passage formed by two corresponding outer passage portions of the pair of outer guides, and at least one second passage formed by the other one outer passage portion of one of the pair of outer guides and one of the inner passage portions of the at least one inner guide corresponding to the other one outer passage portion; and passage changing means for regulating the transport direction of the recording medium in the direction perpendicular to the transport plane for the recording medium and changing the first passage and one of the at least one second passage to guide the recording medium to a changed passage.

In accordance with the image recording apparatus of the first aspect of the present invention, preferably, the image recording apparatus further including: first movement means for moving the pair of outer guides in the width direction of the transport path for the recording medium, respectively, wherein the pair of outer guides are movable in the width direction. Further, preferably, the at least one inner guide is fixed in position. Further, preferably, each of the pair of outer guides has two outer passage portions, and the at least one inner guide is an inner guide having an inner passage portion corresponding to one of the two outer passage portions.

Further, preferably, the passage changing means includes: a roller pair arranged immediately upstream the regulating guide, for transporting the recording medium in a nipping state; a leading guide provided integrally with the roller pair, for regulating the recording medium to guide the recording medium into one of the plural passages for the recording medium in the direction perpendicular to the transport plane for the recording medium; and rocking means for rocking the roller pair and the leading guide. Alternately, preferably, the passage changing means includes: a leading guide which is provided on upstream end portions of the pair of outer guides and the at least one inner guide and which rocks the upstream end portions in the direction perpendicular to the transport plane for the recording medium using the pair of outer guides and/or the at least one inner guide as a fulcrum.

In order to achieve the above second object, a second aspect of the present invention is to provide an image recording apparatus, including:

an image recording section for recording an image on a recording medium;

a loading section for loading the recording medium;

feeding means for feeding the recording medium from the loading section to the image recording section;

a discharging section for discharging the recording medium on which the image has been recorded in the image recording section;

transport means for transporting the recording medium from the loading section to the discharging section;

a regulating guide which is arranged in a transport path for the recording medium transported by the transport means from the loading section to the discharging section and which regulates a position of the recording medium in a width direction perpendicular to a transport direction of the recording medium transported by the transport means, wherein the regulating guide has:

a pair of outer guides arranged at outermost positions in the width direction and having in a direction perpendicular to a transport plane for the recording medium two outer passage portions for regulating a position of one end portion of the recording medium in the width direction, and a pair of inner guides arranged between the pair of outer guides and having in the width direction an inner passage portion for regulating a position of another end portion of the recording medium in the width direction at a position in the direction perpendicular to the transport plane for the recording medium corresponding to one outer passage portion of the pair of outer guides, and wherein the regulating guide forms plural passages in the direction perpendicular to the transport plane for the recording medium, the plural passages including:

a first passage that is formed by two corresponding outer passage portions of the pair of outer guides, and a second passage that is formed by the other one outer passage portion of one of the pair of outer guides and the inner passage portion of one of the pair of inner guides corresponding to the other one outer passage portion;

first movement means for moving the pair of outer guides to arrange the pair of outer guides at symmetrical positions with respect to a central position of the first passage for the recording medium in the width direction;

second movement means for moving the pair of inner guides to arrange the pair of inner guides at symmetrical positions with respect to the central position; and passage changing means for regulating the transport direction of the recording medium in the direction perpendicular to the transport plane for the recording medium and changing the first passage and the second passage to guide the recording medium to a changed passage.

Here, preferably, the pair of inner guides have second inner passage portions on sides opposed to each other in the width direction.

Further, preferably, the recording section includes a line head with recording elements arranged over a length including a maximum recording width in the width direction and performs image recording on the recording medium by the line head, and the image recording apparatus further includes: storage means for storing a number of times that each recording element of the line head is driven; and control means for driving the first movement means and the second movement means according to the number of times of driving stored in the storage means to determine the position of the regulating member.

Further, in order to achieve the above third object, a third aspect of the present invention is to provide an image recording apparatus, including:

an image recording section for recording an image on a recording medium;

a loading section for loading the recording medium;

feeding means for feeding the recording medium from the loading section to the image recording section;

a discharging section for discharging the recording medium on which the image has been recorded in the image recording section;

transport means for transporting the recording medium from the loading section to the discharging section;

a regulating guide which is arranged in a transport path for the recording medium transported by the transport means from the loading section to the discharging section and which regulates a position of the recording medium in a width direction perpendicular to a transport direction of the recording medium transported by the transport means, wherein the regulating guide has:

a pair of outer guides arranged at outermost positions in the width direction for regulating a position of one end portion of the recording medium in the width direction, and at least one inner guide arranged between the pair of outer guides and having on both sides in the width direction guide portions for regulating a position of another end portion of the recording medium in the width direction; and movement means for moving at least two of the pair of outer guides and the at least one inner guide continuously in the width direction independently of each other.

In accordance with the image recording apparatus of the third aspect of the present invention, preferably, the pair of outer guides have in the direction perpendicular to the transport plane for the recording medium plural outer passage portions for regulating the position of the one end portion of the recording medium in the width direction, and at least one inner guide has as the guide portions on both sides in the width direction inner passage portions for regulating the position of another end portion of the recording medium in the width direction at a position in the direction perpendicular to the transport plane for the recording medium corresponding to one outer passage portion of the pair of outer guides, wherein the regulating guide forms plural passages in the direction perpendicular to the transport plane for the recording medium, the plural passages including: a first passage formed by two corresponding outer passage portions of the pair of outer guides; and at least one second passage formed by the other one outer passage portion of one of the pair of outer guides and one of the inner passage portions of the at least one inner guide corresponding to the other one outer passage portion, and the image recording apparatus further includes: passage changing means for regulating the transport direction of the recording medium in the direction perpendicular to the transport plane for the recording medium and changing the first passage and one of the at least one second passage to guide the recording medium to a changed passage.

Here, preferably, the passage changing means includes: a roller pair arranged immediately upstream the regulating guide, for transporting the recording medium in a nipping state; a leading guide provided integrally with the roller pair, for regulating the recording medium to guide the recording medium into one of the plural passages for the recording medium in the direction perpendicular to the transport plane for the recording medium; and rocking means for rocking the roller pair and the leading guide.

Further, preferably, the passage changing means includes: a leading guide which is provided at upstream end portions of the pair of outer guides and the at least one inner guide and which is adapted to rock the upstream end portions in the direction perpendicular to the transport plane for the recording medium using the pair of outer guides and/or the at least one inner guide as a fulcrum.

Further, preferably, the movement means moves at least the pair of outer guides independently of each other and continuously in the width direction.

In each of the above aspects, preferably, the passage changing means regulates a leading end of the recording medium in the direction perpendicular to the transport plane for the recording medium and guides the leading end of the recording medium into the changed passage.

In the image recording apparatus of the first aspect of the present invention constructed as described above, the regulating guide for regulating the position of the recording medium includes a plurality of passages (hereinafter also referred to as transport path) in a direction perpendicular to the transport plane and changes the transport path of the recording medium according to the number of transport lines of recording media including that of the singe-line transport, so it is possible for the image recording apparatus to be applied, with a simple construction, not only to two modes of transport of the single-line transport and the parallel transport in two lines but also to various other modes of transport, such as the single-line transport, the parallel transport in two lines, and the parallel transport in three lines.

Further, there is no need for the guide member used at the time of the parallel transport to be moved in the direction perpendicular to the transport plane, so it is possible to achieve high positional accuracy for the guide member, that is, it is possible to ensure in a stable manner high positional accuracy in the width direction for the recording medium, making it possible to perform proper image recording.

In the image recording apparatus according to the second aspect of the present invention constructed as described above, the regulating guide for regulating the position in the width direction of the recording medium includes two passages (i.e., transport paths) in a direction perpendicular to the transport plane, and the transport path of the recording medium is changed according to the number of recording medium transport lines including that of the singe-line transport, so it is possible to realize, with a simple construction, the single-line transport and the parallel transport in two or three lines.

Further, there is no need to move the guide member used at the time of the parallel transport in the direction perpendicular to the transport plane, so the positional accuracy for the guide member is high, that is, it is possible to ensure in a stable manner high positional accuracy in the width direction for the recording medium, making it possible to perform proper image recording.

Further, the pair of outer guides arranged in the width direction of the transport plane and the pair of inner guides arranged between the pair of outer guides are movable symmetrically with respect to the central position in the width direction of the transport path and independently of each other, so it is possible to regulate the recording medium to the transport path in the width direction with high degree of freedom, making it possible to perform the image recording on recording media of various sizes (widths).

Further, as stated above, in the image recording apparatus of another embodiment according to the second aspect of the present invention, the pair of outer guides and the pair of inner guides are movable symmetrically with respect to the central position in the width direction of the transport path and independently of each other, so it is possible to set the transport position of the recording medium with high degree of freedom in the width direction, and even when the image recording is performed by using a line head, the frequency of use of each recording element is leveled out to prevent local deterioration of the recording elements, thereby making it possible to maintain a satisfactory recording performance for the head as a whole.

In the image recording apparatus according to the third aspect of the present invention constructed as described above, there is provided movement means which makes at least two of the pair of outer guides and at least one inner guide movable in the width direction independently of each other and continuously, whereby it is possible, at the time of the parallel transport, to set independently and arbitrarily the width of the passage (i.e., transport path) of the recording medium for the parallel transport in at least two lines. Further, there is no need for a user to manually change the width of the transport path, making it possible to easily change the width of the transport path. Thus, with the image recording apparatus of the present invention, it is possible to easily perform the parallel transport on recording sheets of various different widths.

DESCRIPTION OF THE PREFERRED EMBODIMENTS

In the following, preferred embodiments of the image recording apparatus of the present invention will be described in detail with reference to the accompanying drawings.

The image recording apparatus of the first aspect of the present invention will be explained referring to FIGS. 1 to 7. First, an ink jet printer which applies the image recording apparatus of each of the first to third aspects of the present invention will be explained.

Figure 1:
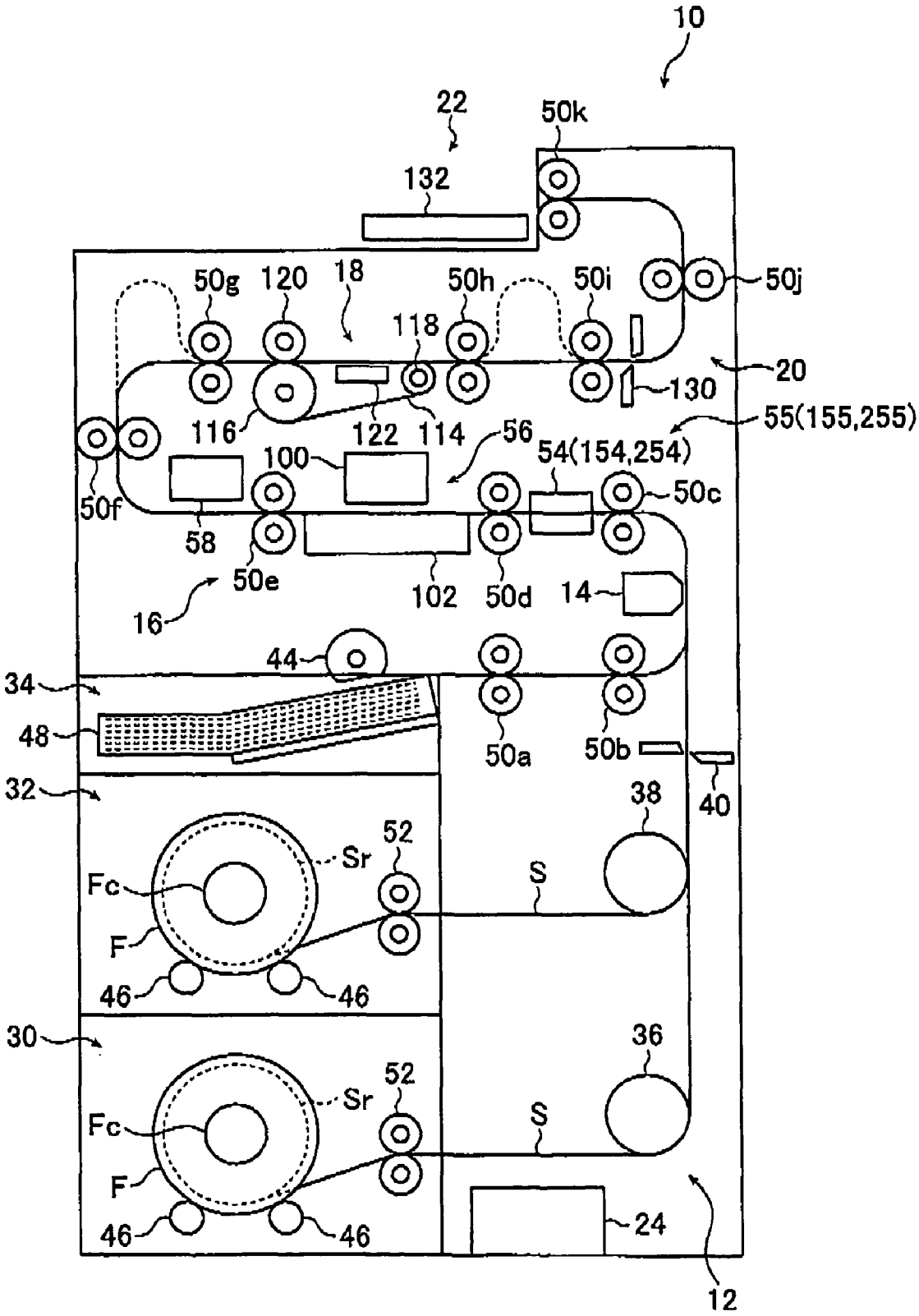
FIG. 1 is a schematic conceptual drawing showing an embodiment of an ink jet printer using an image recording apparatus according to the present invention.

FIG. 1 is a conceptual drawing showing one embodiment of the ink jet printer using the image recording apparatus according to the present invention.

An ink jet printer shown in FIG. 1 (hereinafter referred to as a printer) 10 performs, on a recording sheet S, not only image recording by ink jet but also, as needed, a surface treatment for realizing back printing and a quality equivalent to that of a photograph before outputting a print. The printer 10 basically comprises a recording sheet supplying section 12, a back printer 14, an image recording section 16, a surface treatment section 18, a cutting section 20, and a discharging section 22. Further, the printer 10 comprises a control section 24 for control and management of operation of the printer 10 as a whole, management of historical operational data, etc.

Apart from the components shown, as needed, the printer 10 may naturally include various components of a well-known printer, such as a transport roller pair, a guide roller, a guide member, and a sensor for detecting the recording sheet S or the like.

The recording sheet supplying section 12 is a section for supplying the recording sheet S, which serves as the recording medium, to the back printer 14, and includes a first loading section 30, a second loading section 32, a recording sheet loading section 34, guide rollers 36 and 38, a guillotine cutter 40, a sheet feeding roller 44, and two transport roller pairs 50 (50*a* and 50*b*).

The first loading section 30 and the second loading section 32 are both loaded with a rolled recording sheet Sr formed by winding a long recording sheet S around a core, and feed the recording sheet to the back printer 14 (and downstream sections thereof) through the cutter 40 described below. When the recording sheet S has an ink receiving layer, the recording sheet S is wound with the ink receiving layer facing outwards.

The first loading section 30 and the second loading section 32 are of the same construction except that they differ in their positions in the printer 10, so the same component will be indicated by the same reference numerals, and the following description will center on the first loading section 30.

The first loading section 30 (or the second loading section 32) comprises two flange rotating rollers 46 and a feed roller pair 52 whose rotating direction is matched with the recording sheet feeding direction (i.e., their axes extend in a direction perpendicular to the paper surface of FIG. 1). The flange rotating rollers 46 are arranged in the transport direction while being spaced apart from each other by a predetermined interval.

The feed roller pair 52 is a well-known transport roller pair. The flange rotating rollers 46 and the feed roller pair 52 are both engaged with a well-known rotation drive source (not shown) and are rotated in a normal direction (i.e., the sheet feeding direction) or in a reverse direction (i.e., the sheet rewinding direction).

In the printer 10 shown, the rolled recording sheet Sr is held between two disc-like flanges F (that is, held in the axial direction) having at the center a cylindrical portion Fc fitted onto a core, and, in this state, is placed on the two flange rotating rollers 46, whereby it is loaded at a predetermined position in the printer 10 (i.e., in the first loading section 30 or the second loading section 32). The outer diameter of the flange F is larger than the maximum diameter of the applicable rolled recording sheet Sr.

When preparing prints through parallel transport in two lines described below, two rolled recording sheets Sr each held between the flanges F are placed on the flange rotating rollers 46 to be arranged side by side in the axial direction (i.e., in a direction perpendicular to the paper surface of FIG. 1).

In the first loading section 30 (or the second loading section 32), the flanges F are rotated by the flange rotating rollers 46, and the recording sheet S is transported by the feed roller pair 52 in synchronism therewith, whereby the rolled recording sheet Sr is fed as the recording sheet S. In this process, the flanges F also function as feeding guide members for the recording sheet S.

In the present invention, the method of loading the rolled recording sheet Sr is not restricted to the above-described one. It is possible to utilize all the roll sheet loading methods as adopted in various printers, such as the method using a magazine accommodating the rolled recording sheet Sr rotatably supported at the center, with the magazine being loaded at a predetermined loading position.

The rolled recording sheet Sr as the recording sheet S loaded in the first loading section 30 is guided by the guide roller 36, and transported (i.e., sent out) to the back printer 14 and then to the recording section 16 through the cutter 40. Similarly, the rolled recording sheet Sr as the recording sheet S loaded in the second loading section 32 is guided by the guide roller 38, and transported (i.e., sent out) to the back printer 14 and then to the recording section 16 through the cutter 40.

The cutter 40 is a well-known guillotine cutter. The cutter 40 does not cut the recording sheet S for each print. Instead, the cutter 40 cuts the recording sheet S with a preset (or preselected) predetermined timing, for example, for each document, or when print preparation is to be interrupted (or terminated), or when the operation of the printer 10 is to be stopped.

That is, in the printer 10 shown, when a print is to be prepared by using the rolled recording sheet Sr as the long recording sheet S, back printing by the back printer 14, image recording by the image recording section 16, and surface treatment by the surface treatment section 18 (as needed), are performed on the long recording sheet S, and then cutting is performed at the cutting section 20 to obtain separate prints P.

Thus, when preparing prints by using the rolled recording sheet Sr as the recording sheet S, as in the case of a well-known printer using a recording medium wound up into a roll (so-called roll sheet), the rolled recording sheet Sr is sent out from the first loading section 30 or the second loading section 32 to be used as the recording sheet S, and its leading end is brought to a predetermined position (e.g., the most upstream roller pair of the image recording section 16) by a predetermined route, i.e., through the guide roller 36 or 38, the cutter 40, etc.

After the recording sheet S is cut by the cutter 40, when, in the print preparation, the recording sheet S cut is not to be used, the flange rotating rollers 46 and the feed roller pair 52 are caused to make reverse rotation to rewind the recording sheet S to a predetermined position. In this process, the flanges F also function as a guide for properly guiding the recording sheet S.

The recording sheet loading section 34 is a section for loading cut recording sheets S previously cut into sheets of a predetermined size.

The cut recording sheets S are accommodated in a well-known cassette 48 as used in various printers. When the cassette 48 is loaded at a predetermined position in the recording sheet loading section 34, the cut recording sheets S are loaded at a predetermined position in the printer 10. In the illustrated example, when each cut recording sheet S has an ink receiving layer, the cut recording sheets S are accommodated in the cassette 48 with the ink receiving layers facing downward.

The cut recording sheets S accommodated in the cassette 48 are extracted from the cassette 48 by the sheet feeding roller 44, which is a semicircular roller (i.e., a D-shaped roller) whose side peripheral surface is cut into a flat surface, and are further transported by the transport roller pairs 50*a* and 50*b* before being supplied to the back printer 14 by a transport guide, etc. (not shown).

In the printer 10 in the illustrated example, there are no particular limitations regarding the recording sheet S. It is possible to use various types of well-known recording sheet S (image receiving paper (image receiving medium)), such as an ordinary paper (plain paper), and an ink jet recording paper for photographic quality printing, such as an ink jet recording paper having on a surface thereof a matte or glossy ink receiving layer, an ink jet recording paper having an ink receiving layer formed of thermoplastic resin particles and a pigment ink solvent adsorption layer under the ink receiving layer (see JP 2005-35050 A, etc.), and an ink jet recording paper having an ink receptive thermoplastic resin layer as the ink receiving layer.

Examples of the thermoplastic resin for use in the ink jet recording paper for photographic quality printing include polyacryl ester, polycarbonate, polyacrylonitrile, polystyrene, polybutadiene, poly(meth)acrylic acid, polyvinyl chloride, polyvinylidene chloride, polyvinyl acetate, polyester, polyamide, polyether, and a copolymer of those substances. Above all, preferred examples of the copolymer include polyacrylic ester copolymer, styrene/acrylicester copolymer, vinylchloride/vinylacetate copolymer, vinylchloride/acrylicester copolymer, ethylene/vinylacetate copolymer, ethylene/acrylicester copolymer, and SBR latex.

As stated below, the image recording apparatus of the present invention is not restricted to an ink jet printer. According to the image recording method, it is possible to use various types of recording media, such as silver halide photography photosensitive material, thermal recording material, thermal heat development recording material, and an electrophotographic recording paper for photographic quality printing having a thermoplastic resin layer as an image receiving layer.

Further, the printer 10 (i.e., the image recording apparatus) of the present invention is not restricted to the combined use of a roll sheet and cut sheets. It is also possible for the printer to use a roll sheet alone or cut sheets alone.

When using a roll sheet, instead of cutting it into individual prints at the last stage, it is also possible to cut the recording sheet S immediately after drawing it out of the loading section and to perform back printing or image recording on the cut sheet thus obtained.

The back printer 14 performs back printing on the back surface of the recording sheet S (i.e., the non-image-recording surface (back surface of the ink receiving layer in the case of a recording sheet S having an ink receiving layer) by a dot impact printer or the like. Alternatively, it is possible to perform back printing by an ink jet printer or a thermal printer.

There are no particular limitations regarding the content to be printed through back printing. Examples to be printed through back printing include various information which is standardized in photographic printing.

The image recording section 16 is a section for recording an image by ink jet on the long recording sheet S or the cut recording sheet S. The image recording section 16 comprises, from the upstream side to the downstream side with respect to the transport direction of the recording sheet S, a regulating guide 54 (154, 254) constituting a regulating guide unit 55 (155, 255) which is the feature of the present invention, a recording unit 56 for recording an image on the recording sheet S, and drying means 58. As described below, the regulating guide 154 and 254 of the regulating guide units 155 and 255 are respectively used in the second and the third aspect of the present invention instead of the regulating guide 54 of the regulating guide unit 55 used in the first aspect of the present invention, so the regulating guide 54 and the regulating guide unit 55 are explained as a typical example for the explanation of the whole configuration of the ink jet printer 10 shown in FIG. 1.

Further, a transport roller pair 50*c* is arranged on the upstream side of the regulating guide 54, a transport roller pair 50*d* is arranged between the regulating guide 54 and the recording unit 56, and a transport roller pair 50*e* is arranged between the recording unit 56 and the drying means 58.

The transport roller pair 50*c* comprises its inclination mechanism (81: refer to FIGS. 2A to 2C) and constitutes the passage changing means of the present invention. The transport roller pair 50*c* comprising the inclination mechanism (81) that functions as the passage changing means, the regulating guide 54, and the transport roller pair 50*d* constitute the regulating guide unit 55.

In the example shown, the printer 10 is an apparatus capable of performing image recording (that is, print preparation) through the single line transport, in which only one recording sheet S is transported, and performing image recording through the parallel transport in two lines, in which two recording sheet S are transported while being arranged in a direction (hereinafter referred to as the width direction) perpendicular to the transport direction (i.e., the longitudinal direction in the case of the long recording sheet S). By making such the parallel transport possible, it is possible to enhance the productivity of the printer 10.

The regulating guide 54 arranged on the upstream side of the recording unit 56 (i.e., between the transport roller pairs 50*c* and 50*d*) regulates the recording sheet S which is transported to the recording unit 56 for performing image recording by ink jet to a predetermined position in a direction (hereinafter referred to as a width direction) perpendicular to the transport direction of the recording sheet S.

The image recording apparatus according to the first aspect of the present invention will be explained in detail below by explaining various regulating guide units 55 and 55*a* shown in FIGS. 2A to 7 that are applied to the ink jet printer 10 shown in FIG. 1.

Figure 2C:
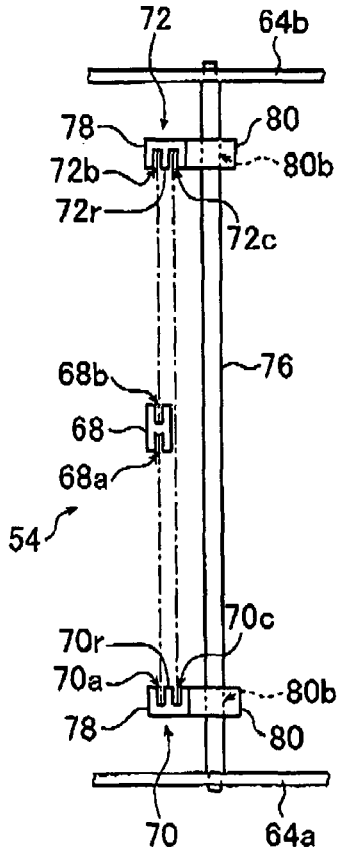
FIGS. 2A, 2B, and 2C are respectively a schematic plan view, a schematic front view, and a schematic side view of one embodiment of a regulating guide unit according to the first aspect of the present invention used in the ink jet printer shown in FIG. 1.
Figure 2A:
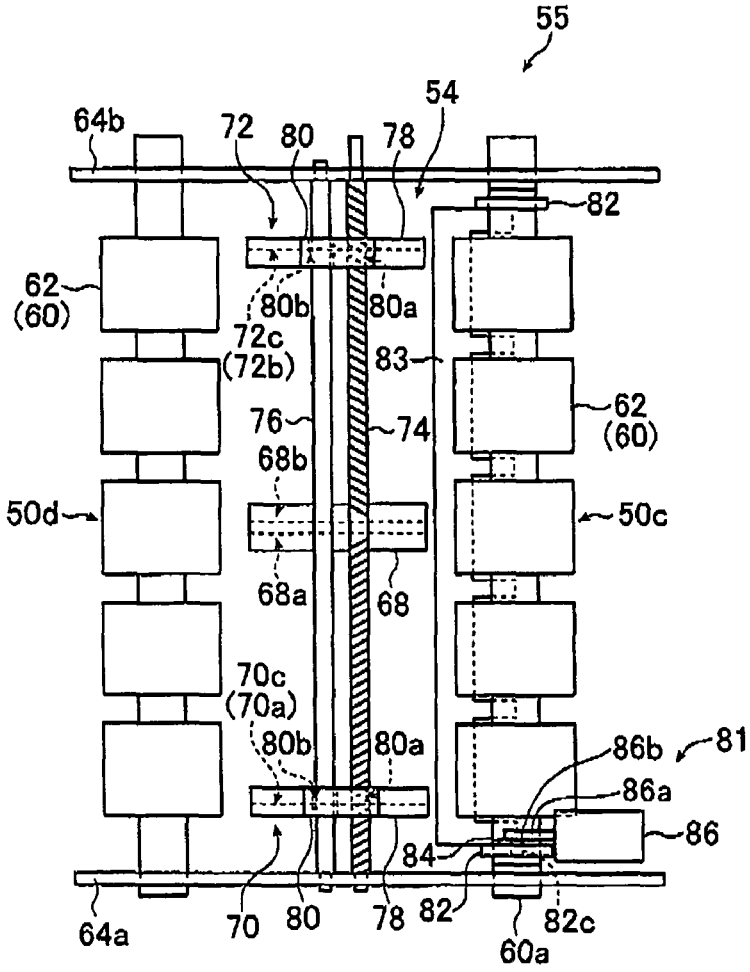
Figure 2B:
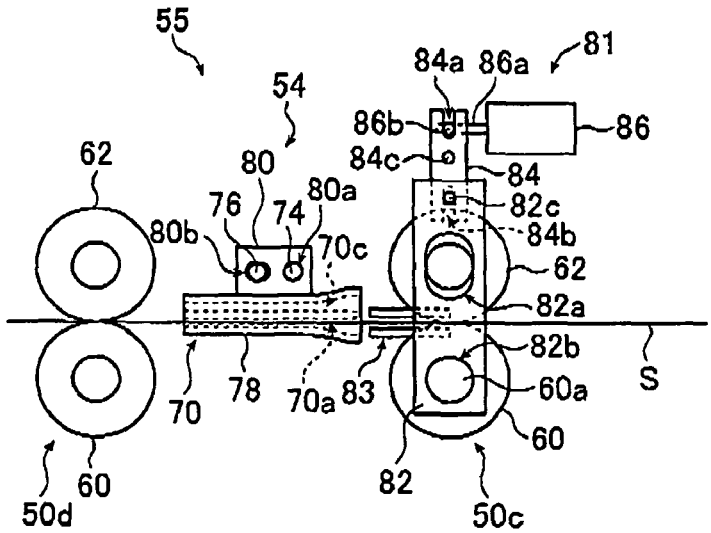

FIGS. 2A through 2C show schematic views of the regulating guide unit 55 comprising the transport roller pair 50*c* including the inclination mechanism 81 which functions as the passage changing means, the regulating guide 54, and the transport roller pair 50*d* used in the ink jet printer 10 shown in FIG. 1, in which FIG. 2A is a plan view thereof (i.e., a top view of FIG. 1), FIG. 2B is a front view (seen in the same direction as in FIG. 1), and FIG. 2C is a side view (as seen from the upstream side with respect to the transport direction for the recording sheet S, and the right-hand side in the figure is the upper side) showing only the regulating guide. To clarify the construction, the transport roller pairs 50*c* and 50*d* are omitted in FIG. 2C. Further, to clarify the construction, frames 64*a* and 64*b* described below are omitted in FIG. 2B.

The transport roller pair 50*c* and the transport roller pair 50*d* are each a transport roller pair composed of a driving roller 60 (with the rotation drive source omitted) on the lower side and a driven roller 62 on the upper side. All the rollers are divided rollers (i.e., comb-teeth rollers) divided in the width direction.

The driving roller 60 of the transport roller pair 50*c*, and the driving roller 60 and the driven roller 62 of the transport roller pair 50*d* are rotatably supported by the frames 64*a* and 64*b*, and the driven roller 62 of the transport roller pair 50*c* is rotatably supported by brackets 82 of the inclination mechanism 81 described below. This feature will be described in detail below.

Basically, the regulating guide 54 comprises a central fixed guide 68 which is fixed in position at the center in the width direction, two variable-width guides 70 and 72 arranged on both sides in the width direction of the central fixed guide 68, a screw shaft 74, and a guide shaft 76. In the example shown, the central fixed guide 68 corresponds to the inner guide, and the variable-width guides 70 and 72 correspond to the outer guides.

The screw shaft 74 extends in the width direction, is rotatably supported by the frames 64*a* and 64*b*, and is turned by a rotation drive source (not shown). The screw shaft 74 is a so-called double-end screw shaft having a right-hand thread on one outer side of the center in the axial direction and a left-hand thread on the other outer side of the center in the axial direction.

On the other hand, the guide shaft 76 is a bar-like member extending in the width direction and fixed to the frames 64*a* and 64*b*.

The central fixed guide 68 is a guide member which, when image recording is performed on the recording sheets S transported in parallel in two lines, regulates the position of the end on the central side of each recording sheet S with respect to the width direction (hereinafter, this side will be simply referred to as inner side, and the sides opposite thereto will be referred to as the outer sides).

In the example shown, the central fixed guide 68 exhibits a substantially H-shaped sectional configuration, and has slit-like passage portions (i.e., the inner passage portions) 68*a* and 68*b* through which the inner side end portions of two recording sheets S transported in parallel pass, with each of the inner passage portions being open at one end and closed at the other end.

The central fixed guide 68 is fixed at a predetermined position at the center in the width direction of a transport path for the recording sheet S, with the H-shaped section being visible in the transport direction and the open ends of the passage portions 68*a* and 68*b* being directed outwards.

On the other hand, both the variable-width guides 70 and 72 are guide members which, in the case of the single-line transport, regulate the positions of the end portions in the width direction of one recording sheet S, and which, in the case of the parallel transport, regulate the positions of the respective outer end portions of two recording sheet S.

The variable-width guide 70 comprises a guide portion 78 with a substantially E-shaped sectional configuration having slit-like passage portions (i.e., an outer passage portions) 70*a* and 70*c* through which the end portion of the recording sheet S (one end portion in the case of the single-line transport, and the outer end portions in the case of the parallel transport) passes and which are open at one end and closed at the other end, with a rib 70*r* being provided therebetween, and an engagement portion 80 provided on the guide portion 78 (on the E-shaped portion). The variable-width guide 72 has a construction similar to that of the variable-width guide 70; it has a guide portion 78 with a substantially E-shaped sectional configuration having passage portions 72*b* and 72*c* through which the end portion of the recording sheet S passes and the engagement portion 80 provided on the guide portion 78.

The variable-width guides 70 and 72 are respectively arranged on either side in the width direction of the central fixed guide 68 (i.e., on the outer sides in the width direction of the central fixed guide 68), with the E-shaped portions being visible in the transport direction, the open ends of the passage portions being directed inwardly, and the two passage portions being stacked together in a direction (hereinafter referred to as a vertical direction) perpendicular to the transport plane for the recording sheet S.

As the preferred aspect, the central fixed guide 68 and the variable-width guides 70 and 72 shown in FIG. 2B are configured such that the upstream end portions of their passage portions expand gradually toward the upstream side, thereby enabling the recording sheet S to be inserted into the passage portions easily and reliably.

The engagement portion 80 of each of the variable-width guides 70 and 72 has a screw hole 80*a* into which the screw shaft 74 is screwed, and a guide hole 80*b* through which a part of the guide shaft 76 is passed while slightly in slide contact therewith.

One of the right-hand thread and the left-hand thread of the screw shaft 74 is screwed into the screw hole 80*a* of the variable-width guide 70, and the other thread of the screw shaft 74 is screwed into the screw hole 80*a* of the variable-width guide 72.

Further, the variable-width guides 70 and 72 are arranged so as to be outwardly spaced apart from the center in the width direction by the same distance, with the central fixed guide 68 being therebetween.

Thus, by turning the screw shaft 74, the variable-width guides 70 and 72 move toward or away from each other symmetrically with respect to the center in the width direction (i.e., the central fixed guide 68) according to the turning direction, thus making it possible to adjust the distance therebetween and the distances between them and the central fixed guide 68.

In the regulating guide 54 shown, the central fixed guide 68 and the variable-width guides 70 and 72 are arranged such that the passage portions 68*a* and 68*b* of the central fixed guide 68, the passage portion 70*a* of the variable-width guide 70, and the passage portion 72*b* of the variable-width guide 72 are at the same vertical position, The central fixed guide 68 is fixed at a position lower than the plane connecting the passage portion 70*c* of the variable-width guide 70 and the passage portion 72*c* of the variable-width guide 72.

Figure 3A:
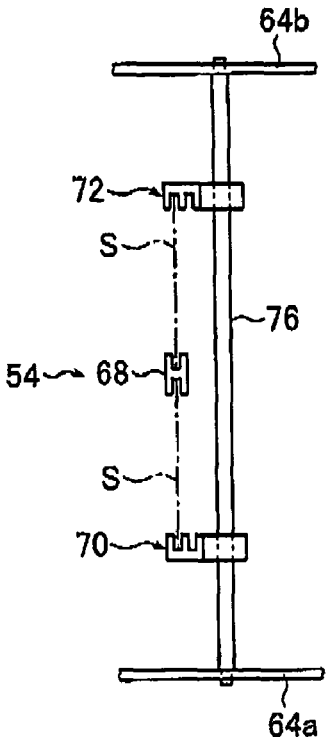
FIGS. 3A and 3B are respectively a schematic front view and a schematic side view for illustrating the operation of the regulating guide unit shown in FIGS. 2A through 2C.
Figure 3B:
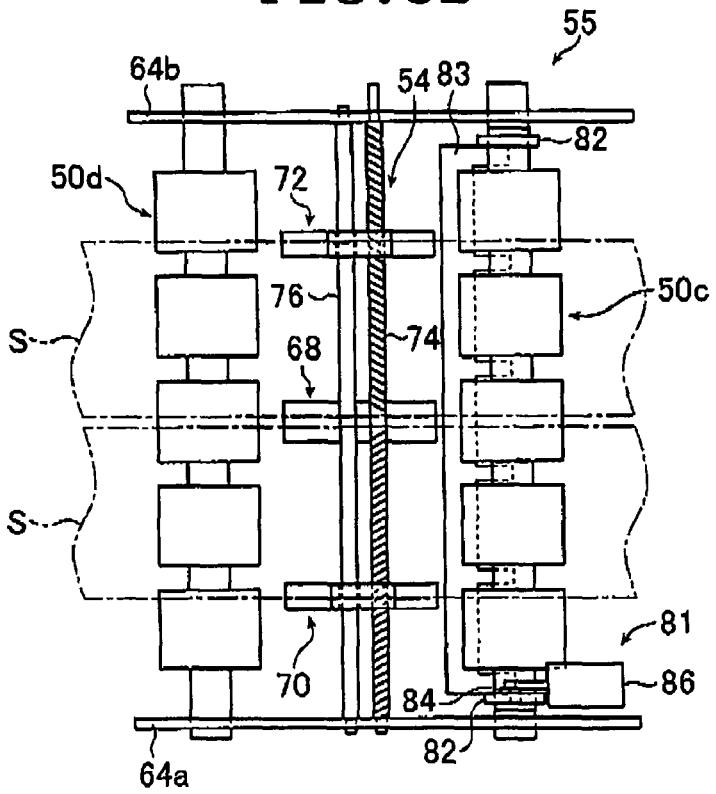

That is, in the regulating guide 54, two passages (hereinafter also referred to as transport paths) are formed in the vertical direction, and as shown in FIGS. 3A and 3B, when performing the parallel transport in two lines, in the lower transport path where the central fixed guide 68 is arranged is used, one recording sheet S is regulated in its position in the width direction and undergoes positioning in the width direction by the passage portion 68*a* of the central fixed guide 68 and the passage portion 70*a* of the variable-width guide 70, and the other recording sheet S is regulated in its position in the width direction and undergoes positioning in the width direction by the passage portion 68*b* of the central fixed guide 68 and the passage portion 72*b* of the variable-width guide 72 before being transported to the recording unit 56 on the downstream side.

Figure 4A:
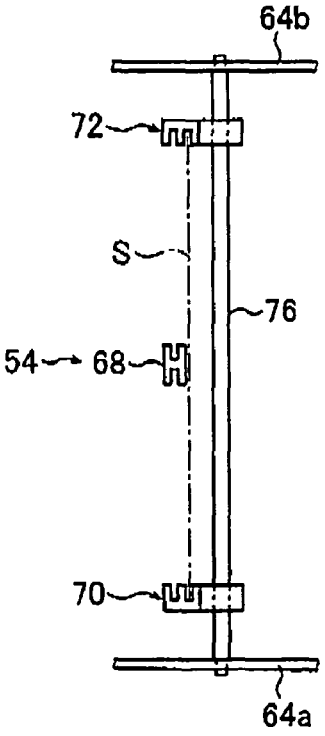
FIGS. 4A and 4B are respectively a schematic front view and a schematic side view for illustrating the operation of the regulating guide unit shown in FIGS. 2A through 2C.
Figure 4B:
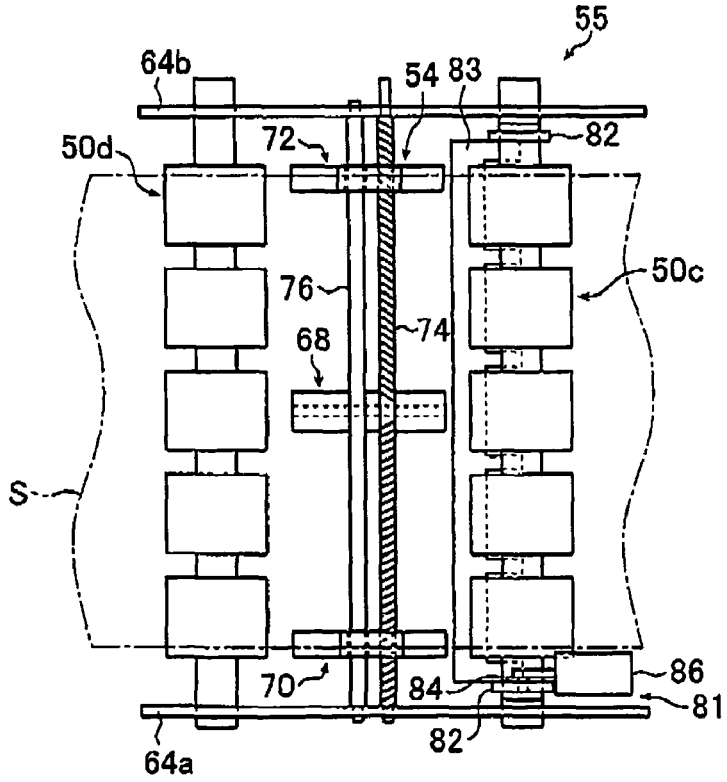

As shown in FIGS. 4A and 4B, when performing the single-line transport, the upper transport path with no central fixed guide 68 is used; a single recording sheet S is regulated in its position in the width direction and undergoes positioning in the width direction by the passage portion 70*c* of the variable-width guide 70 and the passage portion 72*c* of the variable-width guide 72 before being transported to the recording unit 56 on the downstream side.

By adjusting the distance between the variable-width guides 70 and 72, it is possible to handle the recording sheets S of various sizes (i.e., widths) regardless of whether it is the single-line transport or the parallel transport that is to be performed.

In the printer 10 shown, the inclination mechanism 81 of the transport roller pair 50*c* arranged on the upstream side of the regulating guide 54 functions as passage changing means which regulates the vertically arranged transport paths (i.e., passages) for the recording sheet S, guiding two recording sheet S to the lower transport path for the parallel transport (hereinafter referred to as the parallel path for the sake of convenience), where the central fixed guide 68 is used and where the two recording sheets S are regulated in their positions in the width direction by the passage portion 68*a* of the central fixed guide 68 and the passage portion 70*a* of the variable-width guide 70 and by the passage portion 68*b* of the central fixed guide 68 and the passage portion 72*b* of the variable-width guide 72, or guiding a single recording sheet S to the upper transport path for the single-line transport (hereinafter referred to as the single-line path for the sake of convenience), where the central fixed guide 68 is not used and where the single recording sheet S is regulated in its position in the width direction by the passage portion 70*c* of the variable-width guide 70 and the passage portion 72*c* of the variable-width guide 72.

Hereinafter, the inclination mechanism 81 of the transport roller pair 50*c* which functions as the passage changing means will be explained.

As stated above, the lower driving roller 60 of the transport roller pair 50*c* is rotatably supported by the frames 64*a* and the 64*b*.

On the other hand, the upper driven roller 62 of the transport roller pair 50*c* is rotatably supported by elongated holes 82*a* of the brackets 82 which are arranged on the inner side of the frames 64*a* and 64*b*. The brackets 82 are rotatably supported by the driving roller 60 (i.e., the rotation shaft 60*a*) by virtue of holes 82*b*.

A leading guide 83 is fixed to the brackets 82.

The leading guide 83 comprises two rectangular guide plates having comb-teeth-like protrusions and recesses in their longer sides. The two guide plates forming the leading guide 83 are inserted into the roller dividing portions of the transport roller pair 50*c* with their longitudinal direction matched with the width direction and with its comb-teeth portions on the downstream side, and their end portions in the width direction are fixed between the brackets 82 so as to hold vertically, with some clearance provided, the transport paths for the recording sheet S transported by the transport roller pair 50*c*. The two guide plates are fixed to the brackets 82 so that plate surfaces of those are in parallel with the transport plane of the recording sheet S transported by the transport roller pair 50*c*.

A pin 82*c* is fixed to the upper portion of one of the brackets 82 so as to protrude inwardly. A lever 84 is engaged with the pin 82*c*.

The lever 84 is a substantially rectangular plate member whose longitudinal direction is matched with the vertical direction, and is swingably supported at its center by a pin 84*c*. The pin 84*c* is fixed, for example, to the frame 64*a*. At the longitudinal ends of the lever 84, there are formed elongated-hole-like notches 84*a* and 84*b*. The pin 82*c* of the bracket 82 is inserted into and engaged with the lower notch 84*b*.

A solenoid 86 is engaged with the upper notch 84*a* of the lever 84.

The solenoid 86 is a well-known solenoid which extrudes a bar-like piston 86*a* from a predetermined position and accommodates the extruded piston in the predetermined position. The solenoid 86 is arranged so as to extrude the piston 86*a* downstream with respect to the direction in which the recording sheet S is transported. A pin 86*b* is fixed to a distal end of the piston 86*a*. The pin 86*b* is inserted into and engaged with the upper notch 84*a* of the lever 84.

Figure 5A:
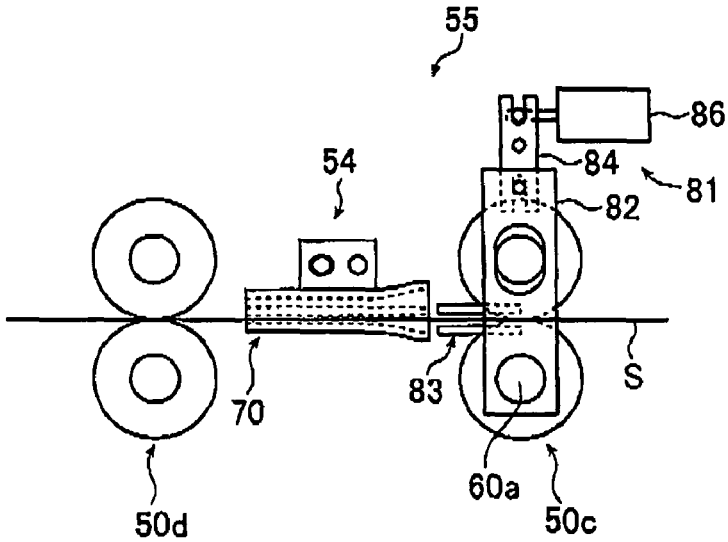
FIGS. 5A and 5B are each a schematic view for illustrating the operation of the regulating guide unit shown in FIGS. 2A through 2C.

As shown in FIG. 2B and FIG. 5A, in the example shown, in the normal state (i.e., the state in which the solenoid 86 has not extruded the piston 86*a* yet), the central fixed guide 68 and the variable-width guides 70 and 72 are arranged such that the parallel path (i.e., the lower transport path where the central fixed guide 68 is used) constitutes the transport path where the recording sheet S is transported by the transport roller pairs 50*c* and 50*d*.

Thus, as shown in FIG. 5A, the leading guide 83 comprising the guide plates parallel to the transport path where transport is effected by the transport roller pair 50*c* is in the state in which the leading guide 83 guides the recording sheets S into the parallel path. The recording sheets S transported by the transport roller pair 50*c* are guided by the leading guide 83 and pass through the lower parallel path of the regulating guide 54 (formed by the central fixed guide 68 and the variable-width guides 70 and 72) to be regulated in their positions in the width direction, and are further supplied to the transport roller pair 50*d* before being transported to the recording unit 56 (i.e., a reference guide 102 thereof) on the downstream side.

Figure 5B:
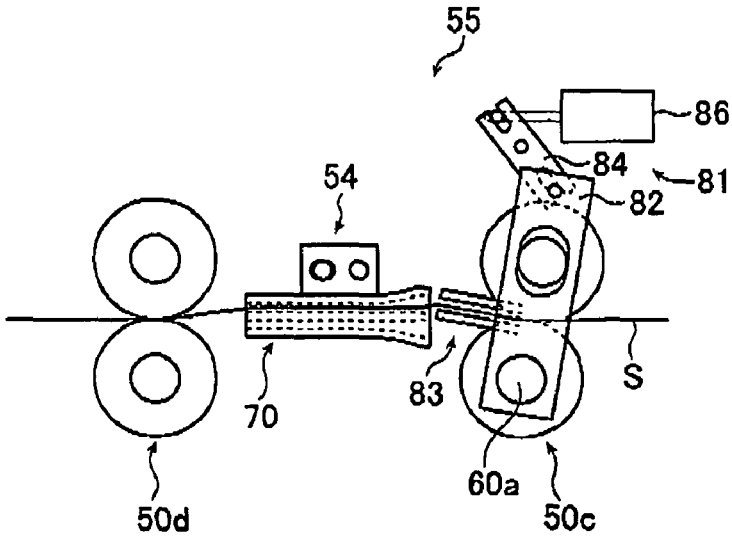

As shown in FIG. 5B, when, in this normal state, the solenoid 86 extrudes the piston 86*a*, the piston 86*a* pushes the upper portion of the lever 84 toward the downstream side. As described above, the lever 84 is swingably supported at the center by the pin 84*c*, so the lever 84 is inclined through this pushing by the piston 86*a*, with its upper portion being on the downstream side and its lower portion on the upstream side.

Due to this inclination of the lever 84, the pin 82*c* on the upper portion of the bracket 82 is pushed toward the downstream side. As stated above, the bracket 82 rotatably supports the driven roller 62, and is rotatably supported by the driving roller 60 (i.e., the rotation shaft 60*a*), so the bracket 82 is inclined about the driving roller 60 through this pushing with its upper portion being directed to the upstream side. As shown in FIG. 5B, as a result of this inclination of the bracket 82, the driven roller 62 rotatably supported by the elongated holes 82*a* moves toward the upstream side along the driving roller 60. Further, the leading guide 83 fixed to the bracket 82 is also inclined, and the transport path where transport is effected by the transport roller pair 50*c* and the leading guide 83 is shifted upwards to the upper transport path, i.e., the single-line path (that is, the single-line passage), where the central fixed guide 68 is not used.

Thus, as shown in FIG. 5B, the recording sheet S transported from the transport roller pair 50*c* in this state is guided by the leading guide 83 and passes through the upper single-line path of the regulating guide 54 (formed by the variable-width guides 70 and 72) and is regulated in its position in the width direction. Further, the recording sheet S is fed and transported to the transport roller pair 50*d* before being transported to the recording unit 56 (i.e., the reference guide 102 thereof) on the downstream side.

In order that the recording sheet S may be reliably transported from the single-line path of the regulating guide 54 to the transport roller pair 50*d*, it is possible to provide a guide member for guiding the recording sheet S from the single-line path to the transport roller pair 50*d*.

In the present invention, the passage changing means for changing to the single-line path and the parallel path is not restricted to the above-described one. It is possible to use various types of other transport passage changing means.

Figure 6A:
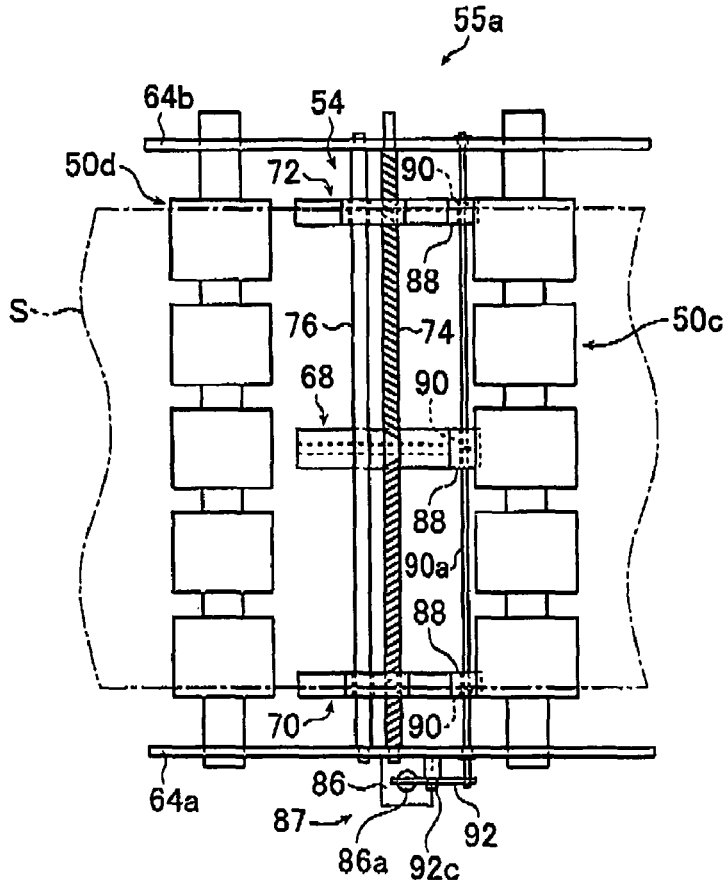
FIG. 6A is a schematic plan view showing another embodiment of the regulating guide unit used in the image recording apparatus according to the first aspect of the present invention.
Figure 6B:
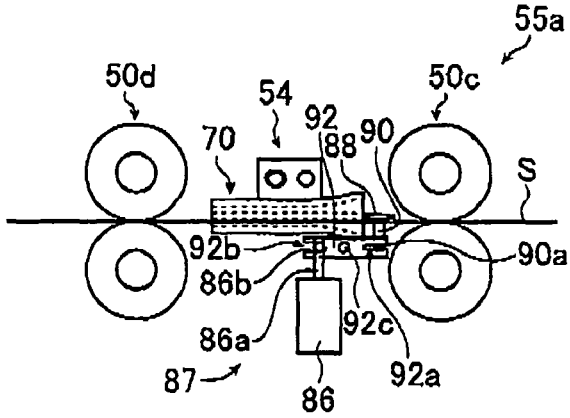
FIGS. 6B and 6C are each a front view showing a different usage pattern of the regulating guide unit shown in FIG. 6A.
Figure 6C:
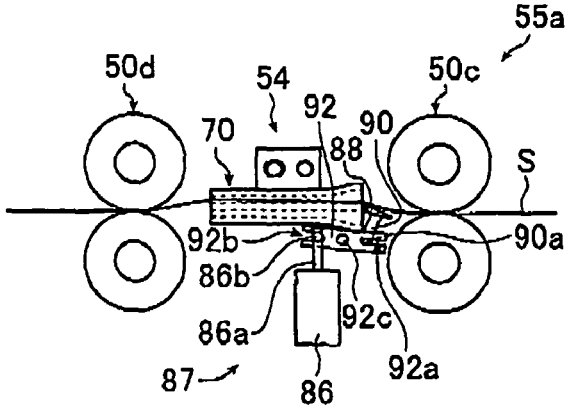

FIGS. 6A through 6C show one embodiment of the regulating guide unit 55*a* comprising another passage changing means, in which FIG. 6A is a plan view of the regulating guide unit 55*a*, and FIGS. 6B and 6C are front views thereof.

The regulating guide unit 55*a* shown in FIGS. 6A to 6C has the same configuration as the regulating guide unit 55 shown in FIGS. 2A to 2C except that the regulating guide unit 55*a* comprises passage changing means 87 instead of the inclination mechanism (passage changing means) 81. Thus, each component of the regulating guide unit 55*a* that is the same as that of the regulating guide unit 55 is given the same reference numeral, and a detailed explanation thereof is omitted. Therefore, different points will be mainly explained.

The passage changing means 87 of the regulating guide unit 55*a* shown in FIGS. 6A to 6C will be explained below. In the passage changing means 87 of the illustrated example, three plate-like leading guides 88 (flappers) for regulating the transport direction of the recording sheet S in the vertical direction are provided at the respective upstream ends of the central fixed guide 68 and the variable-width guides 70 and 72 of the regulating guide 54. In this example, the transport roller pairs 50*c* and 50*d* are all rotatably supported by the frames 64*a* and 64*b*.

The leading guides 88 are of a wedge-like configuration whose thickness gradually decreases in one direction. Their proximal ends (the thicker ends) are fixed to the central fixed guide 68 and the variable-width guides 70 and 72 by such means as hinges, with their thinner ends (hereinafter referred to as distal ends) being on the upstream side. Thus, they can be rocked using their proximal ends as a fulcrum.

Three leading guides 88 are respectively fixed to the upper portions of the upstream end portion of the central fixed guide 68 and the upstream end portions of the ribs 70*r* and 72*r* of the variable-width guides 70 and 72. That is, the leading guides 88 are fixed in position over the lower parallel path.

Plate-like arms 90 are fixed to the lower surfaces of the portions in the vicinity of the distal ends of the leading guides 88. A pin 90*a* is fixed to the lower ends of the arms 90.

As shown in FIG. 6A, the pin 90*a* fixed to the arms 90 extends in the width direction. Specifically, the single pin 90*a* passes through and is engaged with all the arms 90, that is, the arm 90 fixed to the leading guide 88 of the central fixed guide 68, the arm 90 fixed to the leading guide 88 of the variable-width guide 70, and the arm 90 fixed to the leading guide 88 of the variable-width guide 72, thereby fixing all the arms 90.

A lever 92 is a substantially rectangular plate member whose longitudinal direction is matched with the transport direction and which is swingably supported at the center by a pin 92*c*. The lever 92 has at its longitudinal ends elongated-hole-like notches 92*a* and 92*b*. The pin 90*a* fixing the arms 90 is passed through and engaged with the upstream notch 92*a*. The pin 92*c* is fixed, for example, to the frame 64*a*.

A solenoid 86 similar to the one described above is engaged with the downstream notch 92*b* of the lever 92. More specifically, a pin 86*b* at the distal end of the piston 86*a* of the solenoid 86 is inserted into and engaged with the downstream notch 92*b* of the lever 92.

Instead of being provided for each of the central fixed guide 68 and the variable-width guides 70 and 72, the solenoid 86 and the lever 92 are only provided one each.

Also in the example shown in FIGS. 6A through 6C, the central fixed guide 68 and the variable-width guides 70 and 72 are arranged such that the transport path in which the recording sheet S is transported by the transport roller pairs 50*c* and 50*d* is matched with the parallel path (i.e., the lower transport path where the central fixed guide 68 is used).

As shown in FIG. 6B, in the normal state (i.e., the state in which the piston 86*a* is not extruded), the leading guides 88 fixed in position over the lower parallel path as described above are parallel to the transport path where transport is effected by the transport roller pairs 50*c* and 50*d*. Thus, the recording sheets S transported from the transport roller pair 50*c* advance as they are to pass through the lower parallel path of the regulating guide 54 (formed by the central fixed guide 68 and the variable-width guides 70 and 72) to be regulated in their positions in the width direction, and are further fed to the transport roller pair 50*d* before being transported to the recording unit 56 on the downstream side.

As shown in FIG. 6C, when, in this normal state, the solenoid 86 extrudes the piston 86*a*, the piston 86*a* upwardly pushes the downstream side of the lever 92. As stated above, the lever 92 is swingably supported at the center by the pin 92*c*, so the lever 92 is inclined through the pushing by the piston 86*a*, with the downstream side thereof being higher and the upstream side thereof lower.

As a result of this inclination of the lever 92, the arms 90 engaged with the pin 90*a* which is engaged with the notch 92*a* formed at the upstream end of the lever 92 move downwards, and the leading guides 88, with the arms 90 fixed to the lower surfaces of the portions near the distal ends thereof, are inclined with their distal ends lower, thus making the transport path shifted to the upper single-line path.

As stated above, the pin 90*a* fixing the arms 90 is engaged with all the arms 90 respectively fixed to the leading guides 88 of all of the central fixed guide 68 and the variable-width guides 70 and 72. Thus, by driving the solenoid 86, the leading guides 88 of all of the central fixed guide 68 and the variable-width guides 70 and 72 are inclined downwards.

Thus, as shown in FIG. 6C, in this state, the recording sheet S transported from the transport roller pair 50*c* is guided by the leading guides 88 and passes through the upper single-line transport path of the regulating guide 54 (formed by the variable-width guides 70 and 72) to be regulated in its position in the width direction and is further fed and transported to the transport roller pair 50*d* before being transported to the recording unit 56 (i.e., the reference guide 102 thereof) on the downstream side.

In the example shown, the central fixed guide 68 and the variable-width guides 70 and 72 are arranged such that the transport path where transport is effected by the transport roller pairs 50*c* and 50*d* is matched with the parallel path corresponding to the parallel transport, however, this should not be construed restrictively.

Taking into account the burden on the recording sheet S, it is desirable for the transport path normally used in the regulating guide 54 to be matched with the transport path where transport is effected by the transport roller pairs 50*c* and 50*d*.

Further, in the example shown, although two transport paths are arranged in the vertical direction, this should not be construed restrictively.

Figure 7:
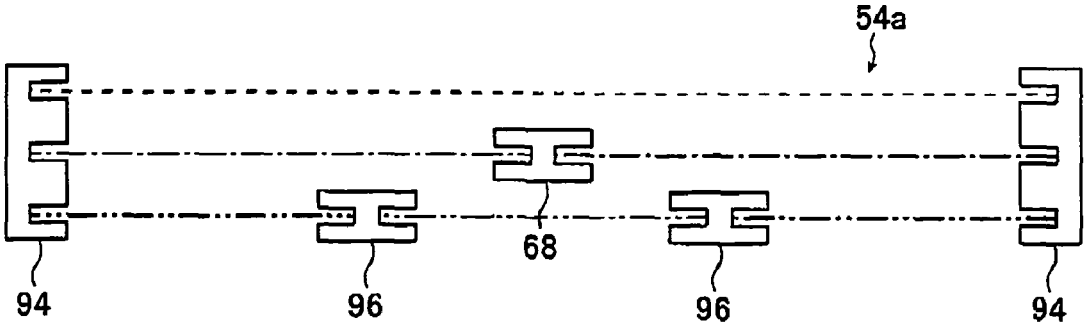
FIG. 7 is a schematic conceptual drawing showing still another embodiment of the regulating guide unit used in the image recording apparatus according to the first aspect of the present invention.

For example, it is also possible to adopt a construction as the regulating guide 54*a* shown in FIG. 7, in which three passage portions are vertically arranged in variable-width guides 94 (that is, outer guides) provided outwardly in the width direction and in which second variable-width guides 96 each having on both sides thereof passage portions for the recording sheet S are provided at positions which are between the central fixed guide 68 and the variable-width guides 94 in the width direction and which do not interfere with the transport plane where the central fixed guide 68 is used, whereby it is possible to perform three modes of transport. The three modes of transport include the single-line transport indicated by the dashed line, the parallel transport in two lines indicated by the alternate long and short dashed line, and the parallel transport in three lines indicated by the chain double-dashed line. The regulating guide 54*a* shown in FIG. 7 may be used instead of the regulating guide 54 of the above described regulating guide unit 55 and 55*a*.

As is apparent from the above description, according to the present invention, in a regulating guide for regulating the positions in the width direction of the recording sheet S, there are formed a plurality of transport paths in the vertical direction (i.e., the direction perpendicular to the transport plane for the recording sheet S), and the single-line transport, the multiple-line transport in two lines, etc. are performed by using these transport paths, so the regulating guide can be easily adapted to a variety of transport modes, thereby making it possible to achieve a substantial improvement in degree of freedom in terms of recording modes for an image recording apparatus utilizing the parallel transport.

Further, since the guide does not move vertically, it is possible to minimize an error in guide position attributable to such vertical movement, that is, it is possible to perform positioning on the recording sheet S with high accuracy and to effect proper image recording free from an error in recording position, etc. In particular, when, as in the case of the example shown, the single-line transport and the multiple-line transport in two lines are performed, it is possible for the inner fixed guide 68 serving as a positioning reference for the recording sheet S in image recording, etc. to be completely in a fixed state, so it is possible to effect positioning on the recording sheet S in the width direction with very high accuracy.

As described above, the recording unit 56 is arranged on the downstream side of the regulating guide 54 (or the transport roller pair 50*d*). On the downstream side of the recording unit 56, there is arranged the transport roller pair 50*e*.

The recording unit 56 comprises well-known ink jet recording means 100 using an ink jet recording head (hereinafter referred to as recording head) and the reference guide 102 for regulating the vertical position of the recording sheet S, and performs well-known full-color image recording by ink jet on the recording sheet S on which positioning in the width direction has been effected by the regulating guide 54.

There are no particular limitations regarding the method of image recording (drawing) by the recording means 100; it may be a well-known method using an ink jet printer.

Thus, as the recording means 100, it is possible to use a line head having a nozzle line (i.e., line of nozzles for ejecting ink droplets) longer than the maximum width of the recording sheet S, and to perform the image recording while continuously transporting the recording sheet S (i.e., transport for scanning), with the nozzle line of the line head being arranged/fixed so as to be matched with the width direction, thus performing image recording by a so-called full width array (FWA) system. Alternatively, it is possible for the recording means 100 to be a small recording head with a nozzle line mounted on a carriage (that is, scanning means) so as to be matched with the transport direction for the recording sheet S, and to perform the image recording through scanning by the recording head with the transport of the recording sheet S being suspended while intermittently transporting the recording sheet S, thus performing image recording by a so-called partial width array (PWA) system.

Thus, when the recording means 100 is one performing image recording by the FWA system, the transport of the recording sheet S by the transport roller pairs 50*c* through 50*e* (and transport roller pair 50*f* described below) is continuous, and when the recording means 100 is one performing image recording by the PWA system, the transport of the recording sheet S by the transport roller pairs 50*c* through 50*e* (and transport roller pair 50*f* described below) is intermittent.

The reference guide 102 may be one simply supporting the recording sheet S from below to regulate the vertical position of the recording sheet S to a predetermined position (where the recording head is at a predetermined distance from the recording sheet S). Alternatively, it is possible to provide a suction hole in the upper surface (i.e., the transport plane for the recording sheet S, that is, the positional reference surface) of the reference guide 102, and to prevent floating, etc. of the recording sheet S by means such as suction from inside, thereby regulating the recording sheet S to a predetermined position more reliably and accurately.

The means for preventing floating of the recording sheet S in the reference guide 102 is not restricted to suction; it is also possible to use various well-known methods, such as a method using static electricity. Further, the reference guide 102 may be one which not only supports the recording sheet S at a predetermined position, but also transports the recording sheet S by using well-known transport means such as a belt conveyor. Further, to prevent contamination by ink when preparing a so-called borderless print with the image recorded up to the ends thereof, the reference guide 102 may have groove-like ink receivers formed in conformity with the width of the recording sheet S concerned.

The drying means 58 is arranged on the downstream side of the recording unit 56 (comprising the reference guide 102 and the recording means 100). Between the recording unit 56 and the drying means 58, there is arranged the transport roller pair 50*e*.

The drying means 58 serves to dry the ink on the recording sheet S that has undergone the image recording by ink jet. There are no particular limitations regarding the drying means 58; it is possible to adopt various well-known methods such as a method using a heater, a method using a fan for blowing air, and a method using both a heater and a fan.

The transport roller pair 50*e* arranged between the reference guide 102 and the drying means 58 is separable; the rollers are separated from each other as needed to thereby prevent adhesion of undried ink.

In the image recording apparatus of the present invention, the image recording method is not restricted to one using ink jet; it is possible to use various well-known image recording methods, such as an image recording method in which a silver halide photography photosensitive material is used as the recording sheet and in which the silver halide photography photosensitive material is imagewisely exposed by a recording light such as a light beam to record a latent image before performing a wet developing process, an image recording method using electrophotography, an image recording method using thermal recording, and an image recording method using a photosensitive thermal development recording material as the recording sheet and in which the photosensitive thermal development recording material is imagewisely exposed by a recording beam such as a light beam to record a latent image before performing thermal development.

After the ink is dried by the drying means 58, the recording sheet S is transported to the surface treatment section 18 by transport roller pairs 50*f* and 50*g*. The section between the transport roller pairs 50*f* and 50*g* constitutes a loop forming section for forming a loop of the recording sheet S. This will be described in detail below.

When an ink jet recording sheet for photographic quality printing having an ink receiving layer formed of thermoplastic resin particles as described above, an ink receiving layer formed of an ink receptive thermoplastic resin layer or the like is used as the recording sheet S, the surface treatment section 18 performs surface treatment on the ink receiving layer (thermoplastic resin).

When the recording sheet S used is other than the ones mentioned above, there is basically no need to perform surface treatment in the surface treatment section 18, so, preferably, the recording sheet S is transported downstream without performing any treatment to the recording sheet S in the surface treatment section 18, with a nip roller 120 described below being separated from a surface treatment belt 114.

However, as needed, it is naturally also possible to perform a surface treatment as described below on the recording sheet S other than an ink jet recording sheet for photographic quality printing.

In the surface treatment section 18, the surface (ink receiving layer) of the recording sheet S is held in contact with the surface of the surface treatment belt 114, and pressurization and heating are performed thereon before cooling, thereby performing surface treatment on the recording sheet S.

In the example shown, in addition to the surface treatment belt 114, the surface treatment section 18 comprises a heating roller 116, a roller 118, the nip roller 120, and a cooling unit 122. The surface treatment belt 114 is an endless belt which is stretched around the heating roller 116 and the roller 118.

The surface treatment belt 114 is a belt with a very high surface (outer surface) smoothness. The heating roller 116 a well-known heating roller which generates heat at a temperature corresponding to the heat treatment for the recording sheet S. The cooling unit 122 is brought into contact with the surface treatment belt 114 from the inside to cool the recording sheet S transported on the surface treatment belt 114. Further, the nip roller 120 is brought into contact with and pressed against the surface treatment belt 114 at a position corresponding to the heating roller 116, whereby the recording sheet S is pressed against the surface treatment belt 114 and is held and transported together with the surface treatment belt 114.

There are no particular limitations regarding the heating means in the heating roller 116 and the cooling means in the cooling unit 122; it is possible to use any well-known means. It is also possible for the nip roller 120 to include heating means.

As is apparent from FIG. 1, the recording sheet S that has undergone the image recording by ink jet is transported to the surface treatment section 18 with the image formation surface facing the surface treatment belt 114.

In the surface treatment section 18, the recording sheet S is first held between the surface treatment belt 114 (i.e., heating roller 116) and the nip roller 120 and transported, whereby the surface (i.e., the ink receiving layer) of the recording sheet S is brought into contact with and pressed against the surface of the surface treatment belt 114 and, at the same time, the recording sheet S is heated by the heating roller 116.

By this heating/pressurization, the ink receiving layer of the recording sheet S formed of thermoplastic resin is melted, and the recording sheet S weakly sticks to the surface treatment belt 114 while it is transported by the surface treatment belt 114. In the surface treatment section 18, during this transport, the recording sheet S is cooled by the cooling unit 122, whereby the melted ink receiving layer is solidified.

The cooled recording sheet S is separated from the surface treatment belt 114 at the turning section using the roller 118, and is supplied to a transport roller pair 50*h* on the downstream side.

The ink receiving layer (thermoplastic resin) of the recording sheet S is brought into the sticking state by thus being pressed against the surface treatment belt 114 and heated/fused. After that, the surface feature of the surface treatment belt 114 is transferred through cooling/solidification. As stated above, the surface treatment belt 114 has very high surface smoothness. Thus, the recording sheet S to which the surface property of the surface treatment belt 114 has been transferred has high surface smoothness and satisfactory glossiness, thereby making it possible to obtain a print of a quality equivalent to that of a silver halide photography print.

Further, in this surface treatment of the recording sheet S, the surface property of the surface treatment belt 114 is selected, whereby it is possible to perform not only the treatment to impart such glossiness, but also various other treatments, such as matting (roughening) treatment.

In the printer 10, it is possible to adjust the heating condition and/or the cooling condition for the surface treatment section 18, whereby it is also possible to adjust the glossiness, etc. to be imparted to the surface of the recording sheet S (print).

Further, in the example shown, the recording sheet S is separated from the surface treatment belt 114 by utilizing the so-called stiffness of the recording sheet S. Thus, preferably, as shown in FIG. 1, the diameter of the roller 118 which is situated at the position where the recording sheet S is discharged from the surface treatment section 18 and around which the surface treatment belt 114 is stretched is made small, whereby it is possible to achieve an improvement in terms of the ease with which the recording sheet S is separated from the surface treatment belt 114.

The recording sheet S which has undergone surface treatment in the surface treatment section 18 or which has passed through the surface treatment section 18 is then transported to the cutting section 20 by transport roller pairs 50*h* and 50*i*. The section between the transport roller pairs 50*h* and 50*i* constitutes a loop forming section for the recording sheet S. This will be described in detail below.

The cutting section 20 uses a well-known guillotine cutter 130 to cut in the width direction the long recording sheet S which is supplied from the first loading section 30 and/or the second loading section 32, having undergone the image recording by ink jet in the image recording section 16, and has undergone surface treatment in the surface treatment section 18 as needed, thereby obtaining a single print (prints are cut off one by one).

In the printer 10, the cutting section 20 is not restricted to the cutting of a long recording sheet S (i.e., a roll sheet). For example, the cutting section 20 may also be used to cut a cut recording sheet S supplied from the recording sheet loading section 34 for cutting the leading-end/trailing-end (with respect to the transport direction) of the recording sheet S according to the print size to be output. The cutting section 20 may also be used to cut the leading-end/trailing-end of a recording sheet for preparing a so-called borderless print with an image recorded up to the ends thereof.

In the printer 10 of the example shown, although the cutting section 20 comprises only the cutter 130 and cuts the recording sheet S only in the width direction, this should not be construed restrictively.

For example, in the recording unit 56, when a so-called multi image allocation in which two or more images are recorded in the width direction is to be performed in the width direction, the cutting section 20 may comprise cutting means such as a slitter for cutting the recording sheet S in the transport direction.

As stated above, the sections between the transport roller pairs 50*f* and 50*g* for transporting the recording sheet S from the image recording section 16 to the surface treatment section 18 and the section between the transport roller pairs 50*h* and 50*i* for transporting the recording sheet S from the surface treatment section 18 to the cutting section 20 each constitutes a loop forming section for forming a loop of the recording sheet S (i.e., sag in the recording sheet S).

In the surface treatment section 18, the recording sheet S weakly sticks to the surface treatment belt 114 by heating/fusing the ink receiving layer of the recording sheet S, and in this state, the recording sheet S is transported/cooled for surface treatment.

Thus, when the transport of the recording sheet S is stopped in the surface treatment section 18, the recording sheet S is overheated or overcooled, with the result that unevenness in surface treatment is generated, which leads to unevenness in the glossiness of the print, etc. Thus, during the treatment in the surface treatment section 18, the transport of the recording sheet S must not be stopped.

Further, during the treatment of the recording sheet S in the surface treatment section 18, if there arises a fluctuation in load in the transport of the recording sheet S, such as forcing of the recording sheet S into the surface treatment section 18 or pulling the recording sheet S out of the surface treatment section 18, the recording sheet S sticking to the surface treatment belt 114 is allowed to be deviated, resulting in unevenness in glossiness.

When, however, the recording means 100 performs the image recording by the PWA system, the transport of the recording sheet S is intermittent. Also, when the recording means 100 performs the image recording by the FWA system, the transport speed (scanning transport speed) of the recording means 100 for image recording and the transport speed of the surface treatment section 18 for surface treatment may differ from each other.

Since the cutting section 20 uses the guillotine cutter 130, it is necessary to stop the transport of the recording sheet S at the time of cutting.

In this connection, in the printer 10, when print preparation is performed by using a long recording sheet S (i.e., a roll sheet) supplied from the first loading section 30 and/or the second loading section 32, there is no need to stop the leading end of the recording sheet S at the transport roller pair 50*g* to stop the transport of the recording sheet S in the surface treatment section 18; after forming a loop of the recording sheet S between the transport roller pairs 50*f* and 50*g* by a sufficient amount not imparting a load fluctuation to the transport of the recording sheet S in the surface treatment section 18, the transport by the transport roller pair 50*g* is started, and the recording sheet S is transported to the surface treatment section 18.

Similarly, when print preparation is performed by using a long recording sheet S, there is no need to stop the leading end of the recording sheet S at the transport roller pair 50*i* to stop the transport in the surface treatment section 18; after forming a loop of the recording sheet S between the transport roller pairs 50*i* and 50*h* by an amount not imparting a load fluctuation, the transport by the transport roller pair 50*i* is started, and the recording sheet S is transported to the cutting section 20 (that is, the guillotine cutter 130).

Further, in order not to impart any load fluctuation to the transport of the recording sheet S in the surface treatment section 18, the transport speed of the transport roller pairs 50*g* and 50*h* is controlled so as to coincide with the transport speed of the recording sheet S in the surface treatment section 18.

Further, the transport by the transport roller pairs 50*i* and 50*j* is an intermittent transport in conformity with the driving of the guillotine cutter 130.

The portions of the recording sheet S cut off by the cutting section 20 (i.e., the guillotine cutter 130), that is, the prints, are discharged to the discharging section 22 by transport roller pairs 50*j* and 50*k*.

In the discharge section 22, the prints are sorted in units of orders by using an orthogonal transport belt (i.e., the belt conveyor) 132 for effecting transport in a direction perpendicular to the paper surface of FIG. 1. The prints are discharged onto the orthogonal transport belt 132 of the discharging section 22 by the transport roller pair 50*k* and are stacked thereon. In a case where prints corresponding to one order have been stacked, the orthogonal transport belt 132 transports the print stack in the depth direction by an amount corresponding to a single print (i.e., its size in the width direction), and the portion of the belt where no print has been stacked yet is used as the position where the prints from the transport roller pair 50*k* are to be discharged. By repeating the stacking/transport, the orthogonal transport belt 132 sorts the prints in units of orders.

In the printer 10 shown, although the regulating guide 54 is arranged between the transport roller pairs 50*c* and 50*d* immediately upstream the recording unit 56, the first aspect of the present invention is not restricted to this construction. The regulating guide may be arranged at various positions in the transport path between the recording sheet supplying section and the print discharging section.

For example, the regulating guide 54 may be arranged immediately upstream the cutter 40 or the cutter 130 of the printer 10 to suppress bending due to cutting. Further, in the image recording apparatus of the present invention, the number of regulating guides is naturally not restricted to one. It is also possible to arrange a plurality of regulating guides in a single image recording apparatus.

Next, the image recording apparatus according to the second aspect of the present invention will be explained referring to FIG. 1, and FIGS. 8A to 14.

Similarly to the various regulating guide units 55 and 55*a* shown in FIGS. 2A to 7, the various regulating guide units 155 and 155*a* shown in FIGS. 8A to 14 are used in the ink jet printer 10 shown in FIG. 1 instead of the regulating guide units 55 and 55*a*. Thus, the explanation of the ink jet printer 10 will be omitted below, and the image recording apparatus according to the second aspect of the present invention will be explained by describing the various regulating guide units 155 and 155*a* shown in FIGS. 8A to 14 that are applied to the ink jet printer 10.

First, the regulating guide unit 155 shown in FIGS. 8A to 8C will be explained.

Figure 8C:
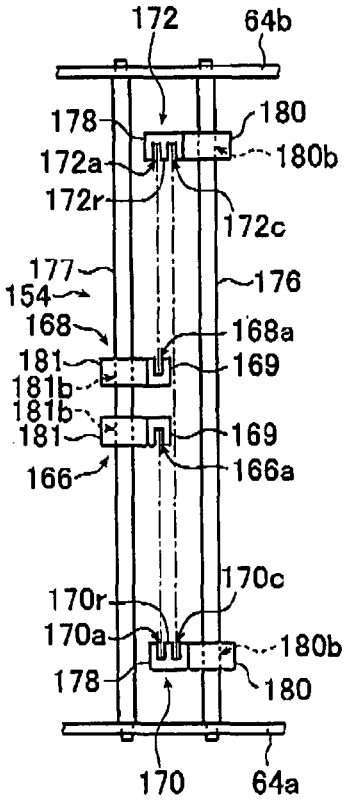
FIGS. 8A, 8B, and 8C are respectively a schematic plan view, a schematic front view, and a schematic side view of still another embodiment of the regulating guide unit according to the second aspect of the present invention used in the ink jet printer shown in FIG. 1.
Figure 8A:
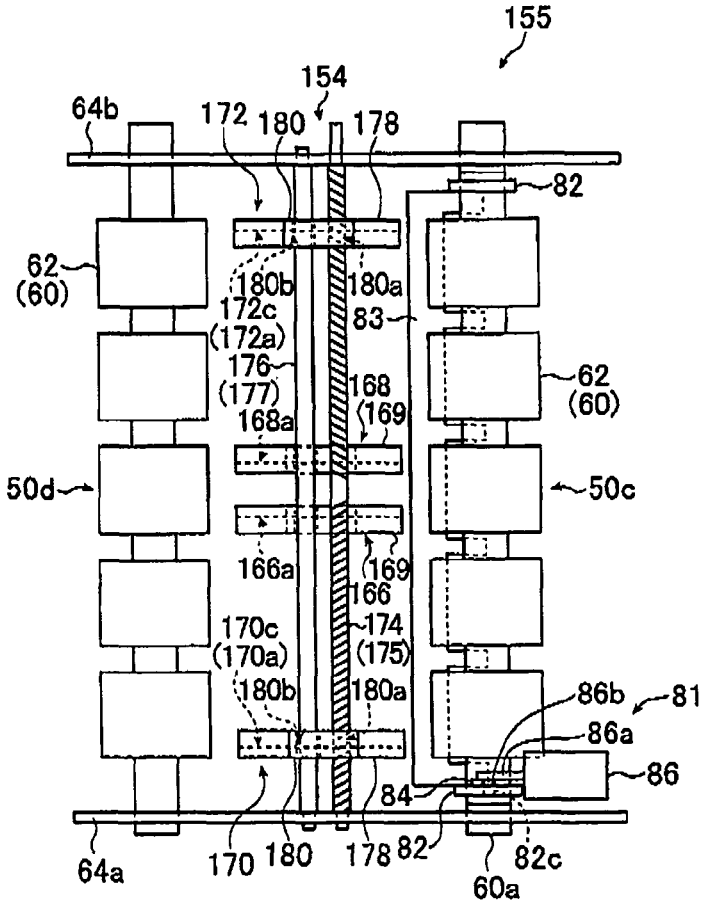
Figure 8B:
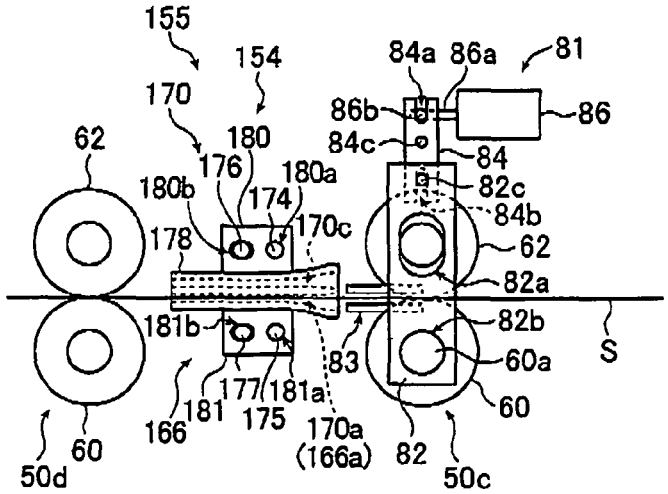

FIGS. 8A through 8C show schematic views of the regulating guide unit 155 which is used in the ink jet printer 10 shown in FIG. 1 and comprises the transport roller pair 50*c* including the inclination mechanism 81 which functions as the passage changing means, the regulating guide 154, and the transport roller pair 50*d*, in which FIG. 8A is a plan view thereof (i.e., a top view of FIG. 1), FIG. 8B is a front view (seen in the same direction as in FIG. 1), and FIG. 8C is a side view (as seen from the upstream side with respect to the transport direction for the recording sheet S, and the right-hand side in the figure is the upper side) showing only the regulating guide. To clarify the construction, the transport roller pairs 50*c* and 50*d* are omitted in FIG. 8C. Further, to clarify the construction, the frames 64*a* and 64*b* described below are omitted in FIG. 8B.

The regulating guide unit 155 shown in FIGS. 8A to 8C has the same configuration as the regulating guide unit 55 shown in FIGS. 2A and 2B except that the regulating guide unit 155 comprises the regulating guide 154 instead of the regulating guide 54. Thus, each component of the regulating guide unit 155 that is the same as that of the regulating guide unit 55 is given the same reference numeral, and a detailed explanation thereof is omitted.

Basically, the regulating guide 154 comprises two (a pair of) inner variable-width guides 166 and 168 movable in the width direction, two (a pair of) outer variable-width guides 170 and 172 arranged on both sides in the width direction of the inner variable-width guides 166 and 168, screw shafts 174 and 175, and guide shafts 176 and 177.

The screw shaft 174 extends in the width direction above the transport plane and is rotatably supported by the frames 64*a* and 64*b*. At one end, the screw shaft 174 is connected to a rotation power source (not shown), and is rotatable. The screw shaft 175 extends in the width direction at a position opposed to the screw shaft 174 with the transport plane therebetween and is rotatably supported by the frames 64*a* and 64*b*. The screw shaft 175 is connected to a rotation power source (not shown) at one end and is rotatable. The screw shafts 174 and 175 are connected to different rotation power sources, and are independently rotatable. Each of the screw shafts 174 and 175 is a so-called double-end screw shaft having a right-hand thread on one outer side of the center in the axial direction and a left-hand thread on the other outer side of the center in the axial direction.

On the other hand, the guide shaft 176 is a bar-like member extending in the width direction above the transport plane and fixed to the frames 64*a* and 64*b*. The guide shaft 177 is a bar-like member similar to the guide shaft 176, and is arranged at a position opposed to the guide shaft 176 with the transport plane therebetween.

The inner variable-width guides 166 and 168 are guide members which, when the image recording is performed on the recording sheets S transported in parallel in two lines, regulate the end position of each recording sheet S on the center side in the width direction (hereinafter, this side will be simply referred to as inner side, and the sides opposite thereto will be referred to as outer sides).

The inner variable-width guide 166 comprises a guide portion 169 of a C-shaped sectional configuration having a slit-like passage portion (i.e., an inner passage portion) 166*a* through which an end portion of the recording sheet S which is transported in parallel passes and which is open at one end and closed at the other end, and an engagement portion 181 provided under the guide portion 169 (under C-shaped portion). On the other hand, the inner variable-width guide 168 has the same construction as the inner variable-width guide 166. The inner variable-width guide 168 comprises the guide portion 169 of a C-shaped sectional configuration including a passage portion 168*a* through which an end portion of the recording sheet S passes, and an engagement portion 181 provided under the guide portion 169.

Both the inner variable-width guides 166 and 168 are arranged side by side in the width direction of the transport path for the recording sheet S, with the C-shaped portions being visible in the transport direction and the open ends of the passage portions directed outwards.

Both the outer variable-width guides 170 and 172 are guide members which, in the case of the single-line transport, regulate the positions of the end portions in the width direction of a single recording sheet S, and which, in the case of the parallel transport, regulate the positions of the respective outer end portions of two recording sheets S.

The outer variable-width guide 170 comprises a guide portion 178 with a substantially E-shaped sectional configuration including slit-like passage portions (i.e., outer passage portions) 170*a* and 170*c* through which an end portion of the recording sheet S (one end portion in the case of the single-line transport, and the outer end portion in the case of the parallel transport) passes and which are open at one end and closed at the other end, with a rib 170*r* being provided therebetween, and an engagement portion 180 provided on the guide portion 178 (on E-shaped portion). On the other hand, the outer variable-width guide 172 has a construction similar to that of the outer variable-width guide 170. The outer variable-width guide 172 comprises the guide portion 178 with a substantially E-shaped sectional configuration including passage portions 172*a* and 172*c* through which an end portion of the recording sheet S passes, with a rib 172*r* being provided therebetween, and an engagement portion 180 provided on the guide portion 178.

The outer variable-width guides 170 and 172 are both arranged on the outer sides in the width direction of the transport path with the inner variable-width guides 166 and 168 therebetween, with the E-shaped portions being visible in the transport direction, the open ends of the passage portions being directed inwardly, and the two passage portions being stacked together in a direction (hereinafter referred to as a vertical direction) perpendicular to the transport plane for the recording sheet S. Further, the outer variable-width guide 170 is arranged at a position where it is opposed to the inner variable-width guide 166 and paired therewith, and the outer variable-width guide 172 is arranged at a position where it is opposed to the inner variable-width guide 168 and paired therewith.

As shown in FIG. 8B, in the preferred example shown, the inner variable-width guides 166 and 168 and the outer variable-width guides 170 and 172 are configured such that the upstream end portions of their passage portions expand gradually toward the upstream side, thereby enabling the recording sheet S to be inserted into the passage portions easily and reliably.

The engagement portion 181 of each of the inner variable-width guides 166 and 168 has a screw hole 181*a* into which the screw shaft 175 is screwed, and a guide hole 181*b* through which a part of the guide shaft 177 is passed while slightly in slide contact therewith.

One of the right-hand thread and the left-hand thread of the screw shaft 175 is screwed into the screw hole 181*a* of the inner variable-width guide 166, and the other thread of the screw shaft 175 is screwed into the screw hole 181*a* of the inner variable-width guide 168.

Further, the inner variable-width guides 166 and 168 are arranged so as to be outwardly spaced apart from the center in the width direction by the same distance.

The engagement portion 180 of each of the outer variable-width guides 170 and 172 has a screw hole 180*a* into which the screw shaft 174 is screwed, and a guide hole 180*b* through which a part of the guide shaft 176 is passed while slightly in slide contact therewith. The right-hand thread or the left-hand thread of the screw shaft 174 is screwed into the screw hole 180*a* of the outer variable-width guide 170, and the other thread of the screw shaft 174 is screwed into the screw hole 180*a* of the outer variable-width guide 172.

Further, the outer variable-width guides 170 and 172 are arranged so as to be outwardly spaced apart from the center in the width direction by the same distance, with the inner variable-width guides 166 and 168 therebetween.

Thus, by turning the screw shaft 175, the inner variable-width guides 166 and 168 move toward and away from each other symmetrically with respect to the center in the width direction according to the turning direction, thus making it possible to adjust the distance between them. Similarly, by turning the screw shaft 174, the outer variable-width guides 170 and 172 move toward and away from each other symmetrically with respect to the center in the width direction according to the turning direction, thus making it possible to adjust the distance between them.

Due to this construction, the distance between the inner variable-width guide 166 and the outer variable-width guide 170 and the distance between the inner variable-width guide 168 and the outer variable-width guide 172 allow adjustment while maintaining the same distance therebetween.

In the regulating guide 154 shown, the inner variable-width guides 166 and 168 and the outer variable-width guides 170 and 172 are arranged such that the passage portions 166*a* of the inner variable-width guide 166, the passage portion 168*a* of the inner variable-width guide 168, the passage portion 170*a* of the outer variable-width guide 170, and the passage portion 172*a* of the outer variable-width guide 172 are at the same vertical position.

The inner variable-width guides 166 and 168 are fixed at positions lower than the plane connecting the passage portion 170*c* of the outer variable-width guide 170 and the passage portion 172*c* of the outer variable-width guide 172.

Figure 9A:
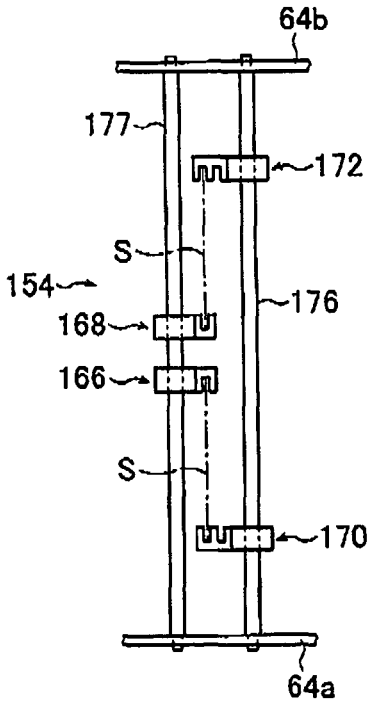
FIGS. 9A and 9B are respectively a schematic front view and a schematic side view for illustrating the operation of the regulating guide unit shown in FIGS. 8A through 8C.
Figure 9B:
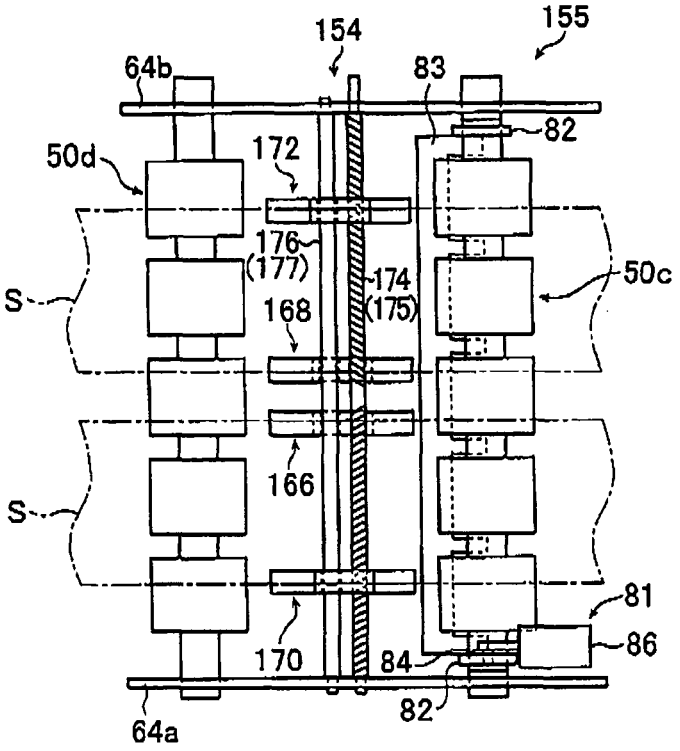

That is, in the regulating guide 154, two passages (i.e., transport paths) are formed in the vertical direction. As shown in FIGS. 9A and 9B, when performing the parallel transport in two lines, the lower transport path where the inner variable-width guides 166 and 168 are arranged is used, one recording sheet S is regulated in its position in the width direction and undergoes positioning in the width direction by the passage portion 166*a* of the inner variable-width guide 166 and the passage portion 170*a* of the outer variable-width guide 170, and the other recording sheet S is regulated in its position in the width direction and undergoes positioning in the width direction by the passage portion 168*a* of the inner variable-width guide 168 and the passage portion 172*a* of the outer variable-width guide 172 before being transported to the recording unit 56 on the downstream side.

As stated above, the two transport paths for the parallel transport (hereinafter referred to as the parallel paths for the sake of convenience) respectively regulated by the inner variable-width guide 166 and the outer variable-width guide 170 and by the inner variable-width guide 168 and the outer variable-width guide 172 allow width adjustment while maintaining the same width. Thus, at the time of the parallel transport, the regulating guide 154 can simultaneously transport two recording sheet S of the same width.

Further, the inner variable-width guides 166 and 168 and the outer variable-width guides 170 and 172 move independently of each other, whereby the width of the parallel paths can be adjusted with a high degree of freedom. Thus, the regulating guide 154 can perform the parallel transport in conformity with the recording sheets S of various sizes (widths).

Figure 10A:
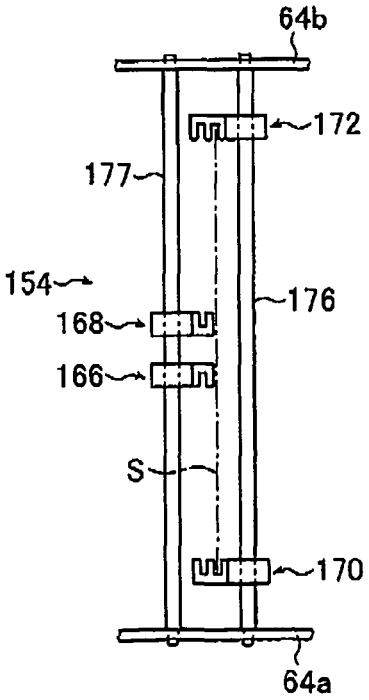
FIGS. 10A and 10B are respectively a schematic front view and a schematic side view for illustrating the operation of the regulating guide unit shown in FIGS. 8A through 8C.
Figure 10B:
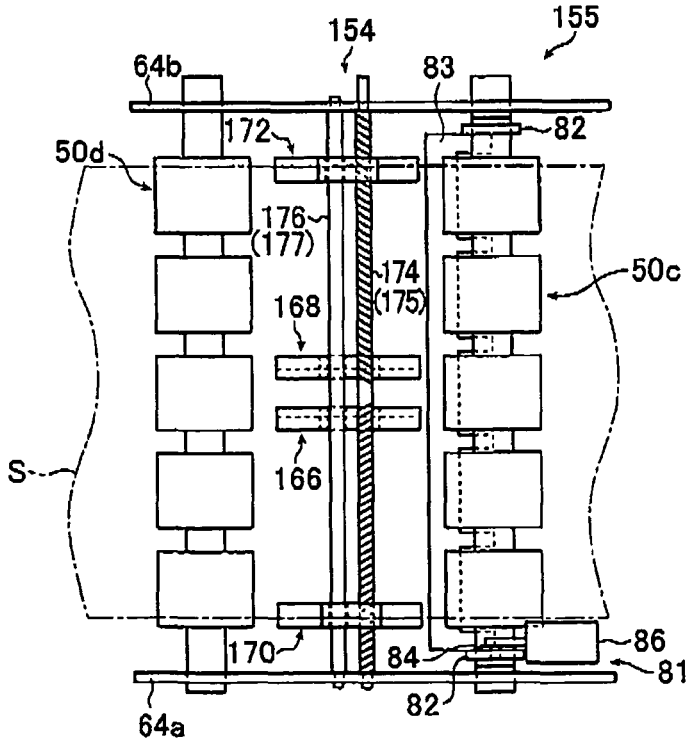

On the other hand, as shown in FIGS. 10A and 10B, when performing the single-line transport, the upper transport path with no inner variable-width guides 166 and 168 is used; a single recording sheet S is regulated in its position in the width direction and undergoes positioning in the width direction by the passage portion 170*c* of the outer variable-width guide 170 and the passage portion 172*c* of the outer variable-width guide 172 before being transported to the recording unit 56 on the downstream side.

By adjusting the distance between the outer variable-width guides 170 and 172, it is possible to adjust the width of the transport path for the single-line transport (hereinafter referred to as the single-line path for the sake of convenience). As a result, the regulating guide 154 can be adapted to the recording sheets S of various sizes (widths) even in the case of the single-line transport.

In the printer 10 shown, the inclination mechanism 81 of the transport roller pair 50*c* arranged on the upstream side of the regulating guide 154 functions as the passage changing means which regulates the vertically arranged transport paths for the recording sheet S, guiding the recording sheet S to the lower transport path for the parallel transport (i.e., the parallel path) where the inner variable-width guides 166 and 168 are used and where the recording sheets S are regulated in their positions in the width direction by the passage portion 166*a* of the inner variable-width guide 166 and the passage portion 170*a* of the outer variable-width guide 170 and by the passage portion 168*a* of the inner variable-width guide 168 and the passage portion 172*a* of the outer variable-width guide 172, or guiding a single recording sheet S to the upper transport path for the single-line transport (i.e., the single-line path) where the inner variable-width guides 166 and 168 are not used and where the recording sheet S is regulated in its position in the width direction by the passage portion 170*c* of the outer variable-width guide 170 and the passage portion 172*c* of the outer variable-width guide 172.

The inclination mechanism 81 shown in FIGS. 8A and 8B has the same configuration as the inclination mechanism 81 shown in FIGS. 2A and 2B, so the explanation thereof is omitted. Hereinafter, the function of the inclination mechanism 81 of the transport roller pair 50*c* of the regulating guide unit 155 shown in FIGS. 8A and 8B as the passage changing means will be explained.

Figure 11A:
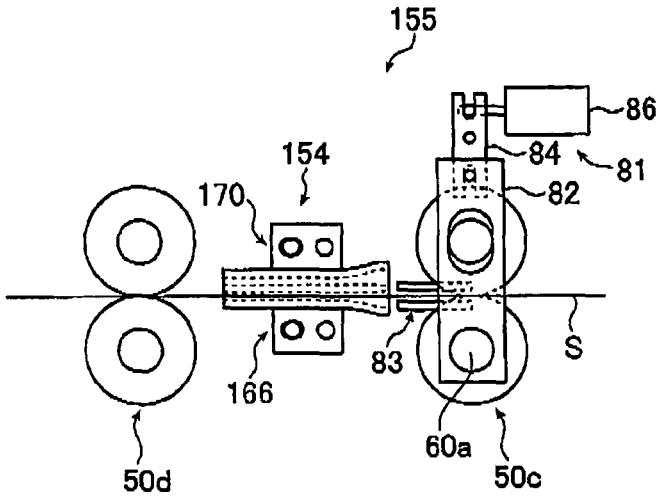
FIGS. 11A and 11B are each a schematic view for illustrating the operation of the regulating guide unit shown in FIGS. 8A through 8C.

As shown in FIG. 8B and FIG. 11A, in the example shown, in the normal state (that is, the state in which the piston 86*a* is not extruded), the inner variable-width guides 166 and 168 and the outer variable-width guides 170 and 172 are arranged such that the parallel path (i.e., the lower transport path where the inner variable-width guides 166 and 168 are used) constitutes the transport path where the recording sheets S are transported by the transport roller pairs 50*c* and 50*d*.

Thus, as shown in FIG. 11A, the leading guide 83 which is formed of guide plates parallel to the transport paths where transport is effected by the transport roller pair 50*c* is in the state in which the leading guide 83 guides the recording sheet S into the parallel path; the recording sheets S transported from the transport roller pair 50*c* are guided by the leading guide 83 and pass through the lower parallel path of the regulating guide 154 (formed by the inner variable-width guides 166 and 168 and the outer variable-width guides 170 and 172) to be regulated in their positions in the width direction, and are further fed and transported to the transport roller pair 50*d* before being transported to the recording unit 56 (the reference guide 102 thereof) on the downstream side.

Figure 11B:
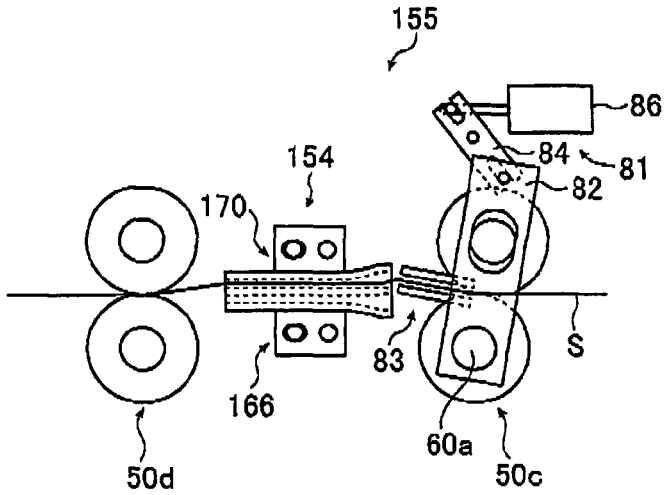

As shown in FIG. 11B, when, in this normal state, the solenoid 86 extrudes the piston 86*a*, the piston 86*a* pushes the upper portion of the lever 84 toward the downstream side. As described above, the lever 84 is swingably supported at the center by the pin 84*c*, so it is inclined through this pushing by the piston 86*a*, with its upper portion being on the downstream side and its lower portion on the upstream side.

Due to this inclination of the lever 84, the pin 82*c* on the upper portion of the bracket 82 is pushed toward the downstream side. As stated above, the bracket 82 rotatably supports the driven roller 62, and is rotatably supported by the driving roller 60 (i.e., the rotation shaft 60*a*), so it is inclined about the driving roller 60 through this pushing with its upper portion being on the upstream side. As shown in FIG. 11B, as a result of this inclination of the bracket 82, the driven roller 62 rotatably supported by the elongated holes 82*a* moves toward the upstream side along the driving roller 60. Further, the leading guide 83 fixed to the bracket 82 is also inclined, and the transport path where transport is effected by the transport roller pair 50*c* and the leading guide 83 is shifted upwards to the upper transport path, i.e., the single-line path where the inner variable-width guides 166 and 168 are not used.

Thus, as shown in FIG. 11B, the recording sheet S transported from the transport roller pair 50*c* in this state is guided by the leading guide 83 and passes through the upper single-line path of the regulating guide 154 (formed by the outer variable-width guides 170 and 172) and is regulated in its position in the width direction. Further, the recording sheet S is fed and transported to the transport roller pair 50*d* before being transported to the recording unit 56 (i.e., the reference guide 102 thereof) on the downstream side.

In order that the recording sheet S may be reliably transported from the single-line path of the regulating guide 154 to the transport roller pair 50*d*, it is possible to provide a guide member for guiding the recording sheet S from the single-line path to the transport roller pair 50*d*.

In this aspect, the passage changing means for changing to the single-line path and the parallel path is not restricted to the above-described one. It is possible to use various types of other transport passage changing means.

Figure 12A:
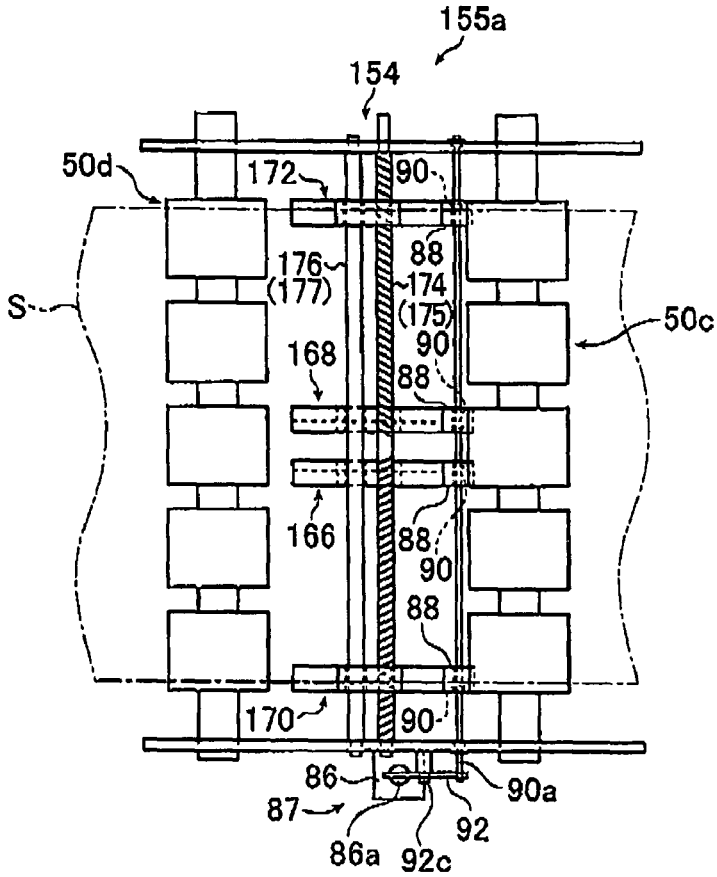
FIG. 12A is a schematic plan view showing still another embodiment of the regulating guide unit used in the image recording apparatus according to the second aspect of the present invention.
Figure 12B:
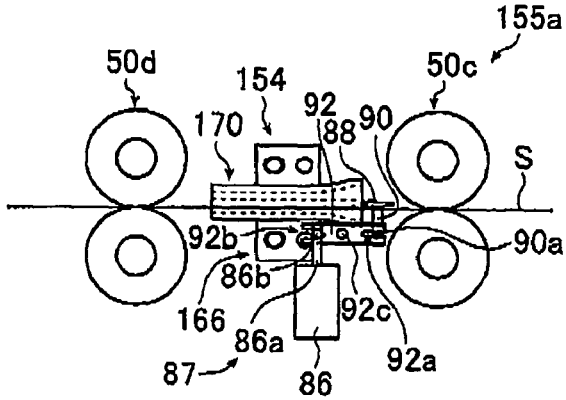
FIGS. 12B and 12C are each a front view showing a different usage pattern of the regulating guide unit shown in FIG. 12A.
Figure 12C:
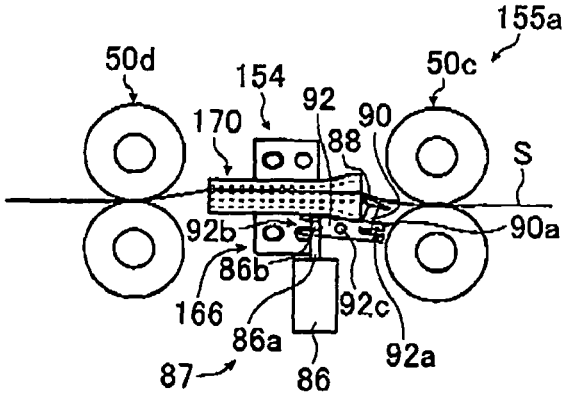

FIGS. 12A through 12C show one embodiment of the regulating guide unit 155*a* comprising another passage changing means, in which FIG. 12A is a plan view of the regulating guide unit 155*a*, and FIGS. 12B and 12C are front views thereof.

The regulating guide unit 155*a* shown in FIGS. 12A to 12C has the same configuration as the regulating guide unit 155 shown in FIGS. 8A to 8C except that the regulating guide unit 155*a* comprises the passage changing means 87 of the regulating guide unit 55*a* shown in FIGS. 6A to 6C instead of the inclination mechanism (passage changing means) 81 of the regulating guide unit 155. Thus, each component of the regulating guide unit 155*a* that is the same as that of the regulating guide unit 155 is given the same reference numeral, and detailed descriptions thereof are omitted. Therefore, different points will be mainly explained.

In the passage changing means 87 shown in FIGS. 12A through 12C, four plate-like leading guides 88 (flappers) for regulating the transport direction of the recording sheet S in the vertical direction are provided at the respective upstream ends of the inner variable-width guides 166 and 168 and the outer variable-width guides 170 and 172. In this example, the transport roller pairs 50*c* and 50*d* are all rotatably supported by the frames 64*a* and 64*b*.

The leading guides 88 are of a wedge-like configuration whose thickness gradually decreases in one direction. Proximal ends (the thicker ends) of the leading guides 88 are fixed to the inner variable-width guides 166 and 168 and the outer variable-width guides 170 and 172 by such means as hinges, with their thinner ends (hereinafter referred to as distal ends) being on the upstream side. Thus, the leading guides 88 can be rocked using their proximal ends as a fulcrum.

The four leading guides 88 are respectively fixed to the upper portions of the upstream end portions of the inner variable-width guides 166 and 168 and to the upstream end portions of the ribs 170*r* and 172*r* of the outer variable-width guides 170 and 172. That is, the leading guides 88 are fixed in position over the lower parallel path.

The plate-like arms 90 are fixed to the lower surfaces of the portions in the vicinity of the distal ends of the leading guides 88. The pin 90*a* is fixed to the lower ends of the arms 90.

As shown in FIG. 12A, the pin 90*a* fixed to the arms 90 extends in the width direction. Specifically, the single pin 90*a* passes through and is engaged with all the arms 90, that is, the arms 90 fixed to the leading guides 88 of the inner variable-width guides 166 and 168, the arm 90 fixed to the leading guide 88 of the outer variable-width guide 170, and the arm 90 fixed to leading guide 88 of the outer variable-width guide 172, thereby fixing all the arms 90.

The lever 92 is a substantially rectangular plate member whose longitudinal direction is matched with the transport direction and which is swingably supported at the center by the pin 92*c*. The lever 92 has at its longitudinal ends the elongated-hole-like notches 92*a* and 92*b*. The pin 90*a* fixing the arms 90 is passed through and engaged with the upstream notch 92*a*. The pin 92*c* is fixed, for example, to the frame 64*a*.

The solenoid 86 similar to the one described above is engaged with the downstream side notch 92*b* of the lever 92. More specifically, the pin 86*b* at the distal end of the piston 86*a* of the solenoid 86 is inserted into and engaged with the downstream notch 92*b* of the lever 92.

Instead of being provided for each of the inner variable-width guides 166 and 168 and the outer variable-width guides 170 and 172, the solenoid 86 and the lever 92 are only provided one each.

Also in the example shown in FIGS. 12A through 12C, the inner variable-width guides 166 and 168 and the outer variable-width guides 170 and 172 are arranged such that the transport path in which the recording sheet S is transported by the transport roller pairs 50*c* and 50*d* is matched with the parallel path (i.e., the lower transport path where the inner variable-width guides 166 and 168 are used).

As shown in FIG. 12B, in the normal state (that is, the state in which the piston 86*a* is not extruded), the leading guides 88 fixed in position over the lower parallel path as described above are parallel to the transport paths where transport is effected by the transport roller pairs 50*c* and 50*d*. Thus, the recording sheets S transported from the transport roller pair 50*c* advance as they are to pass through the lower parallel path of the regulating guide 154 (formed by the inner variable-width guides 166 and 168 and the outer variable-width guides 170 and 172) to be regulated in their positions in the width direction, and are further fed and transported to the transport roller pair 50*d* before being transported to the recording unit 56 on the downstream side.

As shown in FIG. 12C, when, in this normal state, the solenoid 86 extrudes the piston 86*a*, the piston 86*a* upwardly pushes the downstream side of the lever 92. As stated above, the lever 92 is swingably supported at the center by the pin 92*c*, so the lever 92 is inclined through the pushing by the piston 86*a*, with the downstream side thereof being higher and the upstream side thereof lower.

As a result of this inclination of the lever 92, the arms 90 engaged with the pin 90*a* which is engaged with the notch 92*a* formed at the upstream end of the lever 92 move downwards, and the leading guides 88, with the arms 90 fixed to the lower surfaces of the portions near the distal ends thereof, are inclined with their distal ends lower, thus making the transport path shifted to the upper single-line path.

As stated above, the pin 90*a* fixing the arms 90 is engaged with all the arms 90 that are respectively fixed to the leading guides 88 of all of the inner variable-width guides 166 and 168 and the outer variable-width guides 170 and 172. Thus, by driving the solenoid 86, the leading guides 88 of all of the inner variable-width guides 166 and 168 and the outer variable-width guides 170 and 172 are inclined downwards.

Thus, as shown in FIG. 12C, in this state, the recording sheet S transported from the transport roller pair 50*c* is guided by the leading guides 88 and passes through the upper single-line transport path of the regulating guide 154 (formed by the outer variable-width guides 170 and 172) to be regulated in its position in the width direction and is further fed and transported to the transport roller pair 50*d* before being transported to the recording unit 56 (i.e., the reference guide 102 thereof) on the downstream side.

In the example shown, the inner variable-width guides 166 and 168 and the outer variable-width guides 170 and 172 are arranged such that the transport path where transport is effected by the transport roller pairs 50*c* and 50*d* is matched with the parallel path corresponding to the parallel transport, however, this should not be construed restrictively.

Taking into account the burden on the recording sheet S, it is desirable for the transport path normally used in the regulating guide 154 to be matched with the transport path where the transport is effected by the transport roller pairs 50*c* and 50*d*.

Further, in the example shown, although the regulating guide 154 comprises the inner variable-width guides 166 and 168 of a substantially C-shaped sectional configuration to perform the parallel transport in two lines, this should not be construed restrictively.

Figure 13:
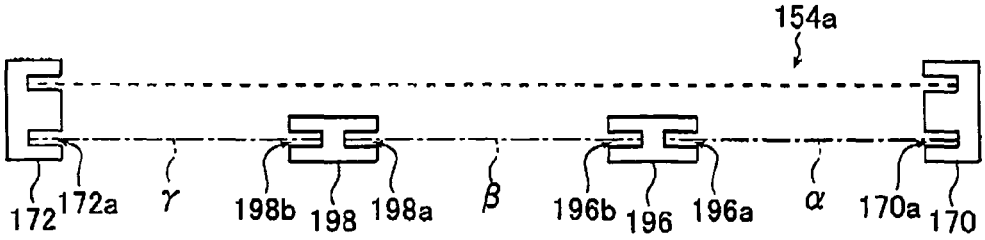
FIG. 13 is a schematic conceptual drawing showing still another embodiment of the regulating guide unit used in the image recording apparatus according to the second aspect of the present invention.

For example, it is also possible to adopt a construction as the regulating guide unit 154*a* shown in FIG. 13, in which there are provided an inner variable-width guide 196 of a substantially H-shaped sectional configuration comprising passage portions 196*a* and 196*b* through which the end portions of recording sheets S to be transported in parallel pass, and an inner variable-width guide 198 of a substantially H-shaped sectional configuration having similar passage portions 198*a* and 198*b*.

In this case, it is possible to perform the parallel transport by using three parallel paths: a parallel path α where the recording sheet passes through the passage portion 170*a* of the outer variable-width guide 170 and the passage portion 196*a* of the inner variable-width guide 196; a parallel path β where the recording sheet passes through the passage portion 196*b* of the inner variable-width guide 196 and the passage portion 198*a* of the inner variable-width guide 198; and a parallel path γ where the recording sheet passes through the passage portion 198*b* of the inner variable-width guide 198 and the passage portion 172*a* of the outer variable-width guide 172.

As stated above, the inner variable-width guides 196 and 198 and the outer variable-width guides 170 and 172 are capable of moving toward and away from each other symmetrically in the width direction, and the distance between the inner variable-width guide 196 and the outer variable-width guide 170 is the same as the distance between the inner variable-width guide 198 and the outer variable-width guide 172, so the parallel paths α and γ are parallel paths of the same width, and the parallel path β can be a parallel path whose width is different from that of the parallel paths α and γ.

In the example shown, the parallel transport in three lines is possible through the three parallel paths α, β and γ. In this case, the parallel transport in tree lines of the same width is possible. Further, it is also possible to perform the parallel transport in three lines by the parallel paths α and γ of the same width, and the parallel path β of a different width.

The mode of the parallel transport is not restricted to the parallel transport in three lines; it is also naturally possible to perform the parallel transport in two lines through two parallel paths selected from the parallel paths α, β and γ. In the case in which the parallel paths α and β or the parallel paths β and γ are selected, it is also possible to perform the parallel transport in two lines on the recording sheets S of different widths.

As is apparent from the above description, according to the second aspect of the present invention, in the regulating guide for regulating the position in the width direction of the recording sheet S, there are formed two transport paths in the vertical direction (i.e., the direction perpendicular to the transport plane for the recording sheet S), and the single-line transport, the parallel transport in two lines, three lines, etc. are performed by using these transport paths, so the regulating guide can be easily adapted to a variety of transport modes.

Further, since each variable-width guide does not move vertically, it is possible to minimize an error in variable-width guide position attributable to such vertical movement. That is, it is possible to perform positioning on the recording sheet S with high accuracy and to effect proper image recording free from an error in recording position, etc.

Further, the inner variable-width guides and the outer variable-width guides are movable independently in the width direction and symmetrically with respect to the central position in the width direction of the transport path, thus making it possible to regulate the transport path with a high degree of freedom in the width direction, whereby it is possible to perform the image recording in conformity with recording media of various sizes (widths).

In particular, in the case of the parallel transport, it is possible to set the positions in the width direction of the two parallel paths formed by the inner variable-width guides and the outer variable-width guides paired with each other, symmetrically with respect to the center of the transport path but with a high degree of freedom in the width direction.

As described above, the recording unit 56 is arranged on the downstream side of the regulating guide 154 (i.e., the transport roller pair 50*d*).

The recording unit 56 comprises the well-known ink jet recording means 100 using an ink jet recording head (hereinafter referred to as a recording head) and the reference guide 102 for regulating the vertical position of the recording sheet S, and performs well-known full-color image recording by ink jet.

In the image recording apparatus disclosed in Patent Document 1 and Patent Document 2, the inner guide used for the parallel transport is fixed. Thus, when these image recording apparatus use a line head for the image recording section, the nozzles (that is, the recording elements) situated near the center of the line head are used in a concentrated manner, with the result that as compared with the other nozzles, the deterioration of the nozzles in this region is allowed to progress.

In contrast, as described above, in the image recording apparatus of the second aspect of the present invention, the inner guides for effecting positioning on the inner sides of the recording sheet S during the parallel transport are movable in the width direction, with the result that it is possible to set the transport path in the width direction for the recording sheet S in the case of the parallel transport with a high degree of freedom, although the inner sides are moved symmetrically with respect to the center in the width direction.

Thus, when the second aspect of the present invention is applied to a line head as the recording unit of the image recording section, the transport path for the recording sheet S at the time of the parallel transport can be changed in the width direction in accordance with the number of times that each nozzle is driven (i.e., the number of times that ink is ejected), the number of prints transported in parallel, the number of prints of each size, etc., thereby leveling out the number of times that each nozzle of the line head is driven. As a result, it is possible to prevent deterioration in image quality due to deterioration in a part of the nozzles, and to achieve improvement in terms of the durability of the line head, thereby elongating the service life of the line head.

In the following, an example of such application of the second aspect of the present invention will be described with reference to FIGS. 14A and 14B.

Figure 14A:
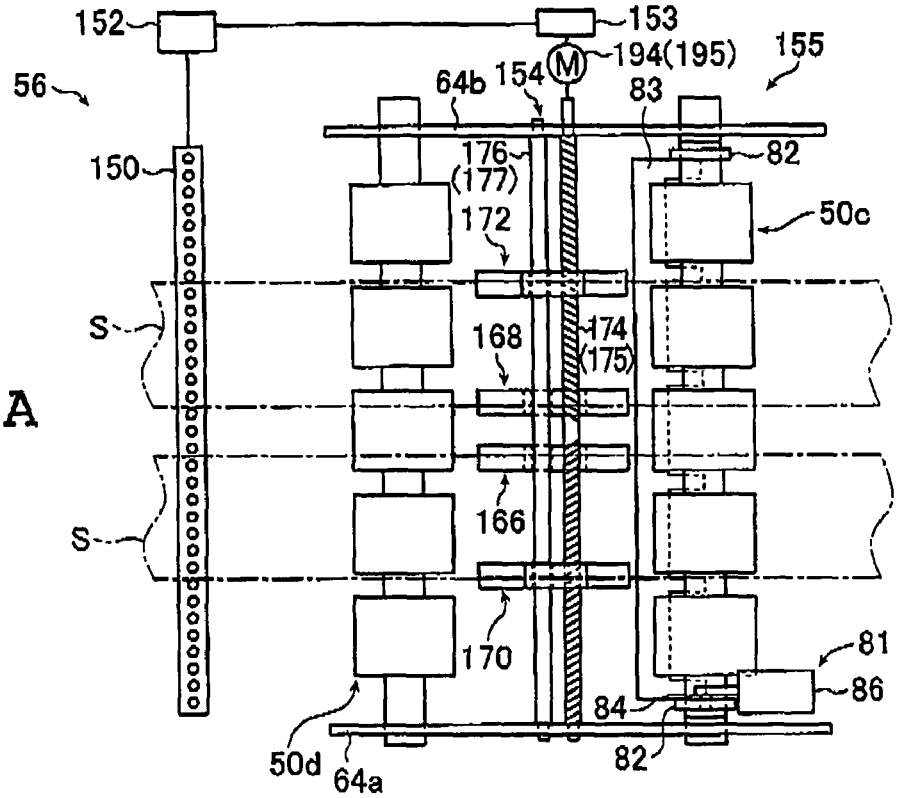
FIGS. 14A and 14B are each a schematic conceptual drawing illustrating the operation of the image recording apparatus according to the second aspect of the present invention which comprises a line head as recording means.
Figure 14B:
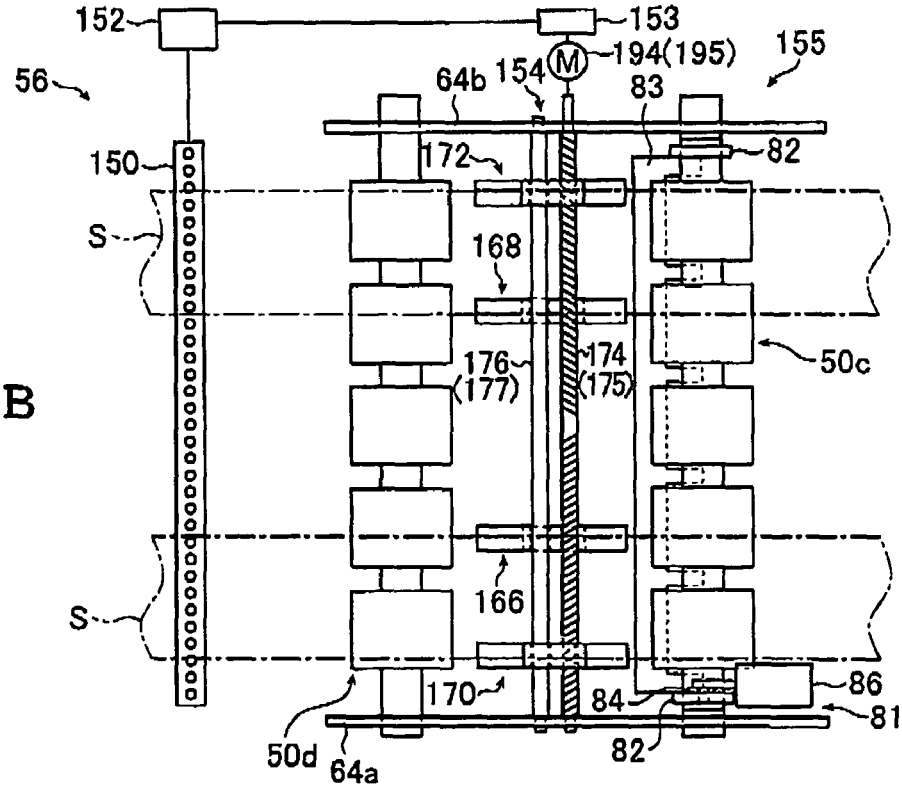

FIGS. 14A and 14B are explanation views of the operation of the image recording apparatus comprising a line head as the recording unit. Specifically, FIGS. 14A and 14B are schematic top views of the recording unit and the regulating guide unit for illustrating the positional relationship between the line head and the transport path for the parallel transport (i.e., the parallel path). FIG. 14A shows the regulating guide 154 when the parallel path is set inwardly in the width direction of the transport path in the case of using a line head 150 as the recording unit 56 and the regulating guide unit 155 shown in FIGS. 8A to 8C as the regulating guide unit in the ink jet printer 10 shown in FIG. 1. FIG. 14B shows the regulating guide 154 when the parallel path is set relatively outwardly in the width direction of the transport path in the case of using the line head 150 and the regulating guide unit 155. The components (members) that are the same as those of the above ink jet printer 10 shown in FIG. 1 and the regulating guide unit 155 shown in FIGS. 8A to 8C are indicated by the same reference numerals, and a detailed explanation thereof will be omitted.

In FIGS. 14A and 14B, a motor 194 is a rotation power source for a screw shaft 174 connected to one end of the screw shaft 174. Similarly, a motor 195 is a rotation power source for a screw shaft 175 connected to one end of the screw shaft 175. The motors 194 and 195 are connected to a drive control section 153.

The drive control section 153 controls the operation of the motors 194 and 195 in response to a control signal from the control section 24, a recording control section 152 described in detail below, etc., and turns the screw shafts 174 and 175, thereby adjusting the positions of the variable-width guides (i.e., the inner variable-width guides 166 and 168 and the outer variable-width guides 170 and 172).

A line head 150 performs the image recording by the FWA system described above, and comprises a nozzle line having a maximum recording width in the width direction. The line head 150 is arranged/fixed with the nozzle line being matched with the width direction.

The recording control section 152 is connected to the line head 150, and transmits a drive signal to each recording element of the line head based on the image data to be recorded to control the operation of the line head 150. Further, the recording control section 152 is capable of storing the number of times that the nozzles of the line head 150 eject ink (hereinafter simply referred to as number of times of ejection). The recording control section 152 determines the positions of the variable-width guides according to the number of times of ejection of the nozzles as stored, and transmits a signal to the drive control section 153 to move the variable-width guides.

As stated above, when performing the parallel transport in two lines, the regulating guide 154 is capable of setting the two parallel paths to predetermined positions within the movable range for the variable-width guides, although they are symmetrical with respect to the center in the width direction.

An example of the method of setting the parallel paths will be described. At the time of the image recording, the recording control section 152 stores the number of times of ejection of each nozzle of the line head 150. Then, at the time of next image recording by the parallel transport, the recording control section 152 reads the number of times of ejection of each nozzle as stored. If there are any nozzles or regions involving a large number of times of ejection, the recording control section 152 decides on transport paths where those nozzles or regions are not used. For example, when, in the case of the transport paths for the recording sheet S shown in FIG. 14A, the number of times of ejection of the nozzles in the region near the center of the line head is larger than the number of times of ejection in the other regions, the recording control section 152 decides on regions other than those shown in FIG. 14A for the transport paths for the parallel transport of the recording sheets S, for example, regions corresponding to the outer portions of the line head as shown in FIG. 14B. The drive control section 153 sets the parallel paths by moving the guides according to positional information on the parallel paths decided upon, that is, the positional information on the guides.

As described above, according to the second aspect of the present invention, the positions in the width direction of the parallel paths are set according to the frequency of use of the nozzles of the line head, whereby the frequency of use of each nozzle of the line head is leveled out, and local deterioration of the recording elements is prevented to thereby improve the durability of the line head, with the result that it is possible to maintain a satisfactory ejection performance for the line head as a whole, thereby making it possible to elongate the service life of the line head.

The above-described parallel path setting method is only given by way of example, and this embodiment is not restricted to this method.

Here, when the image recording is to be performed by the PWA system, that is, when the image recording is to be performed by performing scanning in the width direction with a small recording head (shuttle head) mounted on the carriage (i.e., scanning means), with the transport of the recording sheet S being suspended, it is possible to provide a flashing (that is, blank printing) region between the inner variable-width guides 166 and 168.

In this aspect, similarly to the above described first aspect, it goes without saying that the arrangement positions of the regulating guides and the number of the arranged regulating guides are not limited to the above described example.

Next, an image recording apparatus of the third aspect of the present invention will be explained referring to FIG. 1 and FIGS. 15A to 20C.

Similarly to the various regulating guide units 55 and 55*a* shown in FIGS. 2A to 7, the various regulating guide units 255 and 255*a* shown in FIGS. 15A to 20C are used in the ink jet printer 10 shown in FIG. 1 instead of the regulating guide units 55 and 55*a*. Thus, the explanation of the ink jet printer 10 will be omitted below, and the image recording apparatus according to the third aspect of the present invention will be explained by describing the various regulating guide units 255 and 255*a* shown in FIGS. 15A to 20C that are applied to the ink jet printer 10.

First, the regulating guide unit 255 shown in FIGS. 15A to 15C will be explained.

Figure 15C:
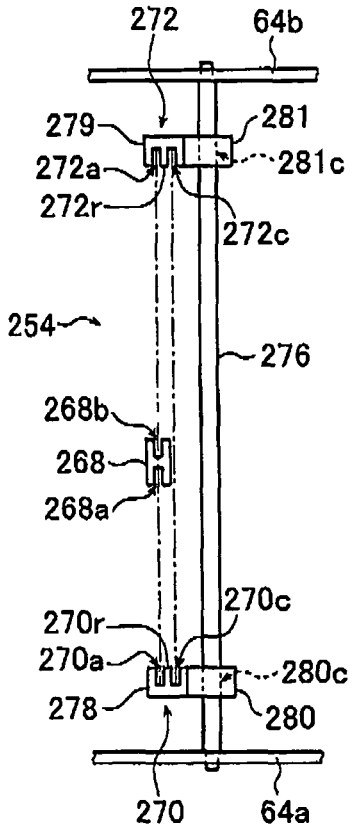
FIGS. 15A, 15B, and 15C are respectively a schematic plan view, a schematic front view, and a schematic side view of still another embodiment of the regulating guide unit according to the third aspect of the present invention used in the ink jet printer shown in FIG. 1.
Figure 15A:
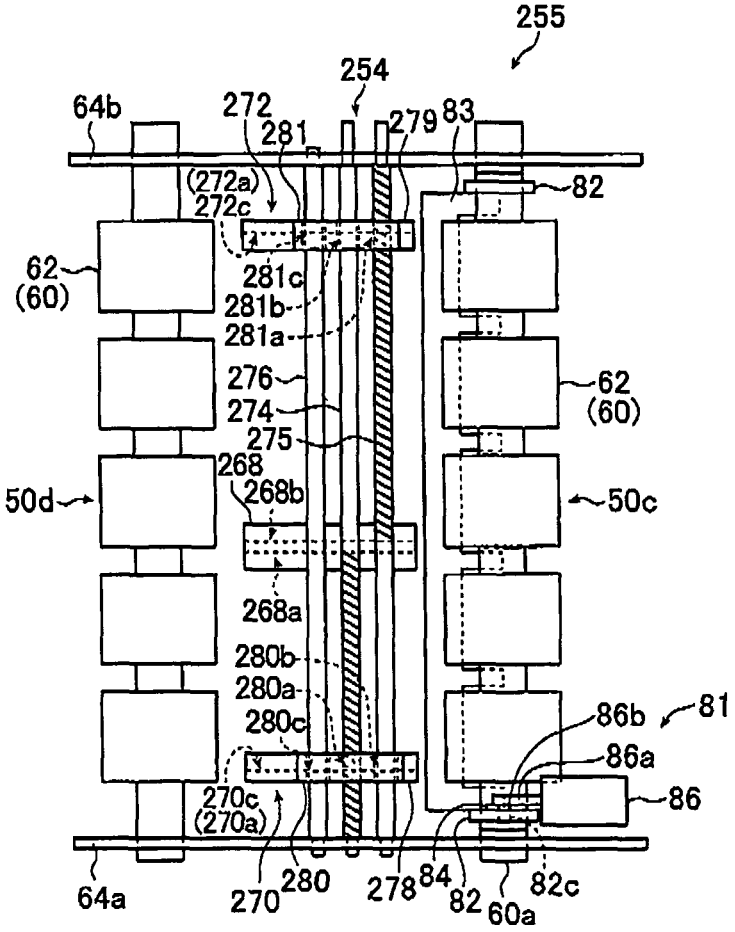
Figure 15B:
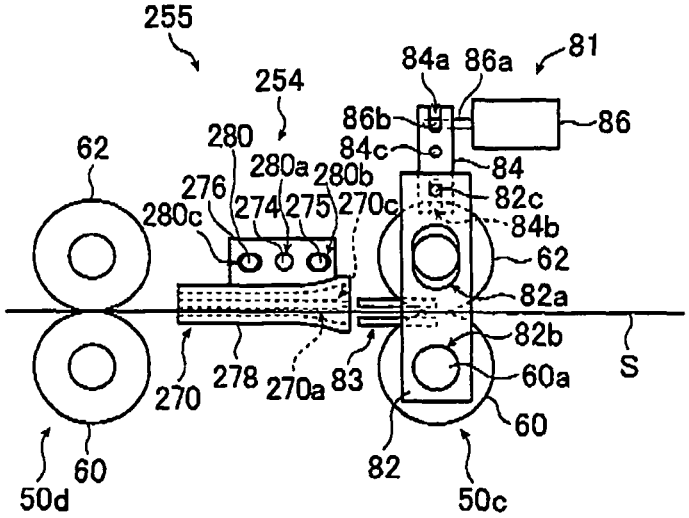

FIGS. 15A through 15C show schematic views of the regulating guide unit 255 which is used in the ink jet printer 10 shown in FIG. 1 and comprises the transport roller pair 50*c* including the inclination mechanism 81 which functions as the passage changing means, the regulating guide 254, and the transport roller pair 50*d*, in which FIG. 15A is a plan view thereof (i.e., a top view of FIG. 1), FIG. 15B is a front view (seen in the same direction as in FIG. 1), and FIG. 15C is a side view (as seen from the upstream side with respect to the transport direction for the recording sheet S, and the right-hand side in the figure is the upper side) showing only the regulating guide. To clarify the construction, the transport roller pairs 50*c* and 50*d* are omitted in FIG. 15C. Further, to clarify the construction, the frames 64*a* and 64*b* described below are omitted in FIG. 15B.

The regulating guide unit 255 shown in FIGS. 15A to 15C has the same configuration as the regulating guide unit 55 shown in FIGS. 2A and 2B except that the regulating guide unit 255 comprises the regulating guide 254 instead of the regulating guide 54 of the regulating ink guide 54. Thus, each component of the regulating guide unit 255 that is the same as that of the regulating guide unit 55 is given the same reference numeral, and a detailed description explanation thereof is omitted.

Basically, the regulating guide 254 comprises a fixed guide 268 fixed at a predetermined position in the width direction, two variable-width guides 270 and 272 arranged on both sides in the width direction of the fixed guide 268, screw shafts 274 and 275, and a guide shaft 276. In the example shown, the fixed guide 268 corresponds to the inner guide, and the variable-width guides 270 and 272 correspond to the outer guides.

The screw shafts 274 and 275 extend in the width direction, and are rotatably supported by the frames 64*a* and 64*b*. The screw shafts 274 and 275 are respectively turned by separate rotation drive sources (not shown).

The screw shaft 274 is a screw shaft having a thread extending from the position of the fixed guide 268 to the position of one frame 64*a*. The screw shaft 275 is a screw shaft having a thread extending from the position of the fixed guide 268 to the position of the other frame 64*b*. As described below, the screw shafts 274 and 275 are screwed into the variable-width guides 270 and 272, respectively.

The guide shaft 276 is a bar-like member extending in the width direction and fixed to the frames 64*a* and 64*b*.

The fixed guide 268 is a guide member which, when image recording is performed on the recording sheets S transported in parallel in two lines, regulates the position of the end on the central side with respect to the width direction (hereinafter, this side will be simply referred to as inner side, and the sides opposite thereto will be referred to as outer sides) of each recording sheet S.

In the example shown, the fixed guide 268 exhibits a substantially H-shaped sectional configuration, and comprises slit-like passage portions (i.e., inner passage portions) 268*a* and 268*b* through which the inner side end portions of the two recording sheet S transported in parallel pass, with each of the inner passage portions being open at one end and closed at the other end.

The fixed guide 268 is fixed at a predetermined position in the width direction of the transport path for the recording sheet S, with the H-shaped section being visible in the transport direction and the open ends of the passage portions 268*a* and 268*b* being directed outwards.

The position of the fixed guide 268 is not restricted to the position shown in the drawing. It is possible to adopt a position selected from various positions, such as the center in the width direction, as long as it is between the variable-width guides 270 and 272.

On the other hand, both the variable-width guides 270 and 272 are guide members which, in the case of the single-line transport, regulate the positions of the end portions in the width direction of one recording sheet S, and which, in the case of the parallel transport, regulate the positions of the respective outer end portions of two recording sheets S.

The variable-width guide 270 comprises a guide portion 278 of a substantially E-shaped sectional configuration including slit-like passage portions (i.e., outer passage portions) 270*a* and 270*c* through which end portions of the recording sheets S (one end portion in the case of the single-line transport, and the outer end portions in the case of the parallel transport) pass and which are open at one end and closed at the other end, with a rib 270*r* being provided therebetween, and an engagement portion 280 provided on the guide portion 278 (on E-shaped portion). It is arranged on the passage portion 268*a* side of the fixed guide 268.

The other variable-width guide 272 has a construction similar to that of the variable-width guide 270. The variable-width guide 272 comprises a guide portion 279 of a substantially E-shaped sectional configuration including passage portions 272*a* and 272*c* through which end portions of the recording sheets S pass, with a rib 272*r* being provided therebetween, and an engagement portion 281 provided on the guide portion 279. The variable-width guide 272 is arranged on the passage portion 268*b* side of the fixed guide 268.

The variable-width guides 270 and 272 are both arranged on either side in the width direction of the fixed guide 268 (i.e., on the outer sides in the width direction of the fixed guide 268), with the E-shaped portions being visible in the transport direction, the open ends of the passage portions being directed inwardly, and the two passage portions being stacked together in a direction (hereinafter referred to as the vertical direction) perpendicular to the transport plane for the recording sheet S.

In the illustrated example, as a preferable aspect, the central fixed guide 268 and the variable-width guides 270 and 272 are configured such that the upstream end portions of their passage portions expand gradually toward the upstream side such as the variable-width guide 270 shown in FIG. 15B, thereby enabling the recording sheet S to be inserted into the passage portions easily and reliably.

The engagement portion 280 of the variable-width guide 270 has a screw hole 280*a* into which the screw shaft 274 is screwed, a guide hole 280*b* through which one end portion of the guide shaft 275 with no thread is passed while slightly in slide contact therewith, and a guide hole 280*c* through which a part of the guide shaft 276 is passed while slightly in slide contact therewith.

On the other hand, the engagement portion 281 of the variable-width guide 272 has a screw hole 281*a* into which the screw shaft 275 is screwed, a guide hole 281*b* through which one end portion of the guide shaft 274 with no thread is passed while slightly in slide contact therewith, and a guide hole 281*c* through which a part of the guide shaft 276 is passed while slightly in slide contact therewith.

Thus, by turning the screw shafts 274 and 275, the variable-width guides 270 and 272 move continuously, respectively, according to the turning direction, toward and away from the fixed guide 268 independently of each other, thus making it possible to continuously adjust the distance between the variable-width guides 270 and 272, the distance between the variable-width guide 270 and the fixed guide 268, and the distance between the variable-width guide 272 and the fixed guide 268.

As described below, in the example shown, it is possible, due to the above-described construction, to transport the recording sheets S of various widths by both the single-line transport and the parallel transport, and in the case of the parallel transport, to transport two kinds of recording sheets S of different widths.

The regulating guide 254 may be formed without providing the guide shaft 276 by using the portion of the screw shaft 275 having no thread as the guide shaft of the variable-width guide 270 and the portion of the screw shaft 274 having no thread as the guide shaft of the variable-width guide 272. In this case, it is possible to further simplify the construction of the regulating guide 254.

In the regulating guide 254 shown, the fixed guide 268 and the variable-width guides 270 and 272 are arranged such that the passage portions 268*a* and 268*b* of the fixed guide 268, the passage portion 270*a* of the variable-width guide 270, and the passage portion 272*a* of the variable-width guide 272, are at the same vertical position.

The fixed guide 268 is fixed at a position lower than the plane connecting the passage portion 270*c* of the variable-width guide 270 and the passage portion 272*c* of the variable-width guide 272.

Figure 16A:
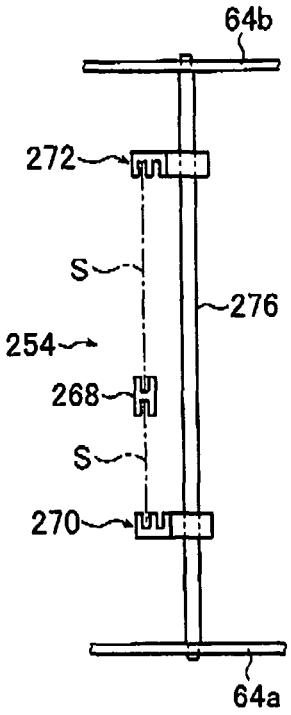
FIGS. 16A and 16B are respectively a schematic front view and a schematic side view for illustrating the operation of the regulating guide unit shown in FIGS. 15A through 15C.
Figure 16B:
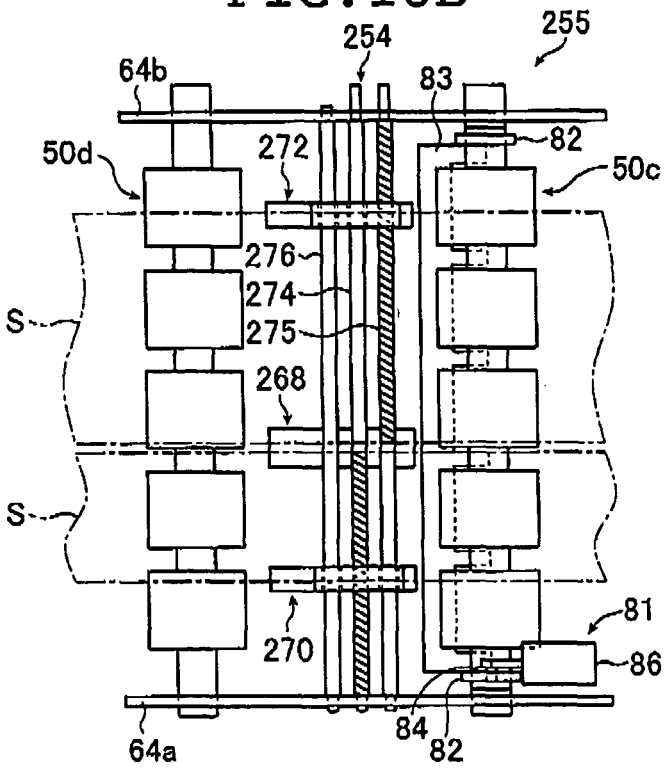

That is, in the regulating guide 254, two passages (i.e., transport paths) are formed in the vertical direction. As shown in FIGS. 16A and 16B, when performing the parallel transport in two lines, the lower transport path where the fixed guide 268 is arranged is used, one recording sheet S is regulated in its position in the width direction and undergoes positioning in the width direction by the passage portion 268*a* of the fixed guide 268 and the passage portion 270*a* of the variable-width guide 270, and the other recording sheet S is regulated in its position in the width direction and undergoes positioning in the width direction by the passage portion 268*b* of the fixed guide 268 and the passage portion 272*a* of the variable-width guide 272 before being transported to the recording unit 56 on the downstream side. Each of the passage portions 268*a* and 268*b* of the fixed guide 268 serves as a reference position for the positioning of the recording sheet S in the parallel transport.

Figure 17A:
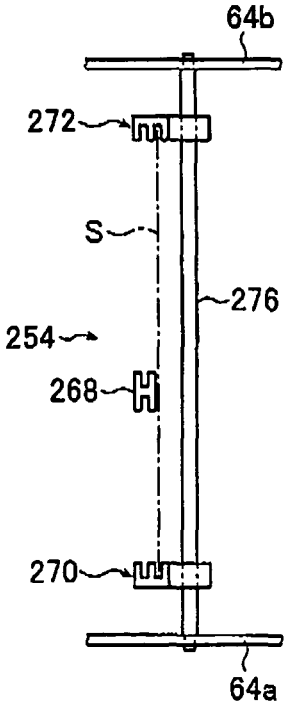
FIGS. 17A and 17B are respectively a schematic front view and a schematic side view for illustrating the operation of the regulating guide unit shown in FIGS. 15A through 15C.
Figure 17B:
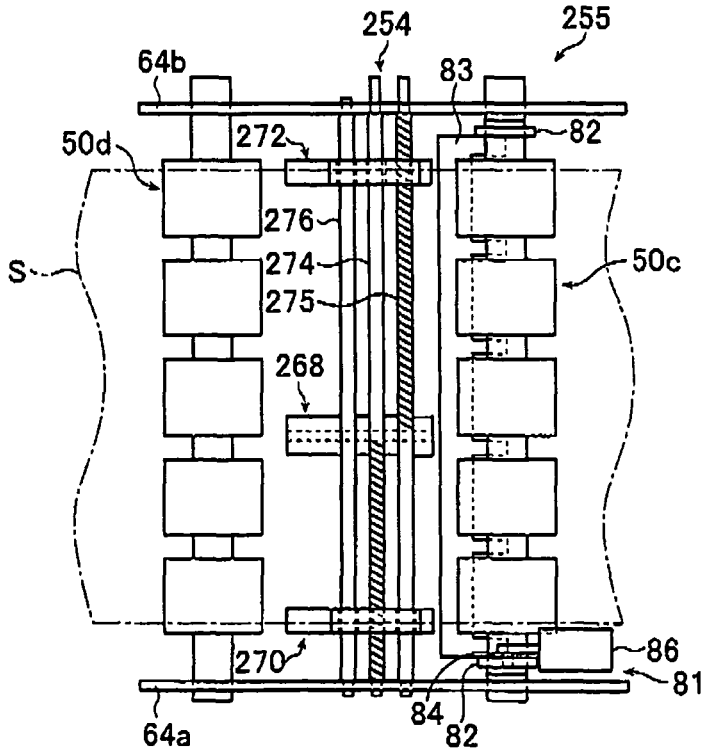

On the other hand, as shown in FIGS. 17A and 17B, when performing the single-line transport, in the upper transport path with no fixed guide 268 is used, a single recording sheet S is regulated in its position in the width direction and undergoes positioning in the width direction by the passage portion 270*c* of the variable-width guide 270 and the passage portion 272*c* of the variable-width guide 272 before being transported to the recording unit 56 on the downstream side.

As stated above, the variable-width guides 270 and 272 are continuously movable in the width direction independently of each other, so by adjusting the positions of the variable-width guides 270 and 272 to arbitrary positions within their movable ranges, it is possible to handle the recording sheets S of various widths (sizes) regardless of whether it is the single-line transport or the parallel transport that is to be performed.

Figure 18A:
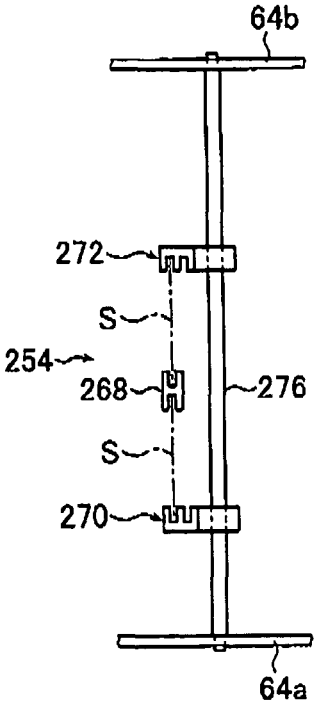
FIGS. 18A and 18B are respectively a schematic front view and a schematic side view for illustrating the operation of the regulating guide unit shown in FIGS. 15A through 15C.
Figure 18B:
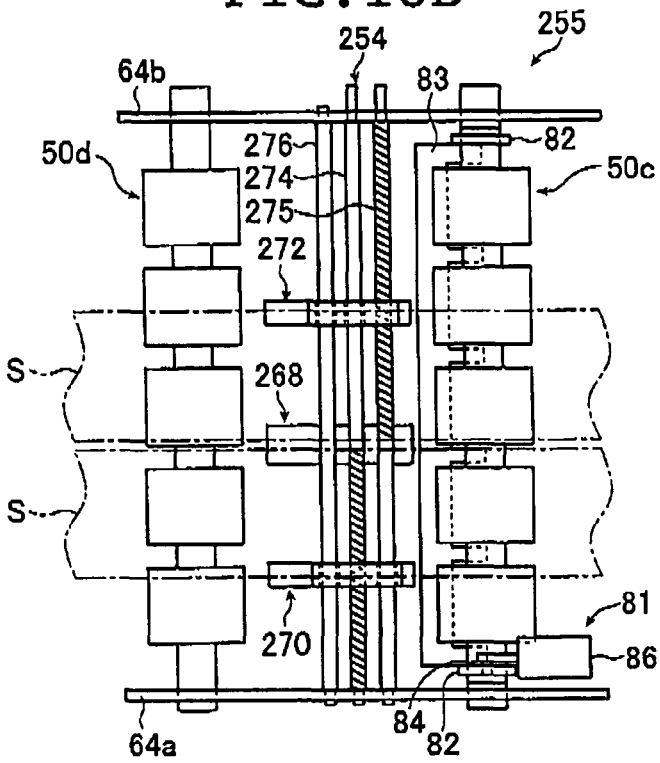

Further, the variable-width guides 270 and 272 are continuously movable in the width direction independently of each other. Thus, if, for example, the recording media to be transported by the parallel transport are the recording sheets S of different widths as shown in FIGS. 16A and 16B, or the recording sheets S of the same width as shown in FIGS. 18A and 18B, it is possible to perform the parallel transport simultaneously by respectively adjusting the positions in the width direction of the variable-width guides according to the width of the recording media.

In the printer 10 shown, the inclination mechanism 81 of the transport roller pair 50*c* arranged on the upstream side of the regulating guide 254 functions as the passage changing means which regulates the vertically arranged transport paths for the recording sheet S, guiding the recording sheets S to the lower transport path for the parallel transport (hereinafter referred to as parallel path for the sake of convenience), where the fixed guide 268 is used and where the recording sheets S are regulated in their positions in the width direction by the passage portions 268*a* and 268*b* of the fixed guide 268, the passage portion 270*a* of the variable-width guide 270, and the passage portion 272*b* of the variable-width guide 272, or guiding a single recording sheet S to the upper transport path for the single-line transport (hereinafter referred to as single-line path), where the fixed guide 268 is not used and where the single recording sheet S is regulated in its position in the width direction by the passage portion 270*c* of the variable-width guide 270 and the passage portion 272*c* of the variable-width guide 272.

The inclination mechanism 81 shown in FIGS. 15A and 15B has the same configuration as the inclination mechanism 81 shown in FIGS. 2A and 2B, so the explanation thereof is omitted. Hereinafter, the function of the inclination mechanism 81 of the transport roller pair 50*c* of the regulating guide unit 255 shown in FIGS. 15A and 15B as the passage changing means will be explained.

Figure 19A:
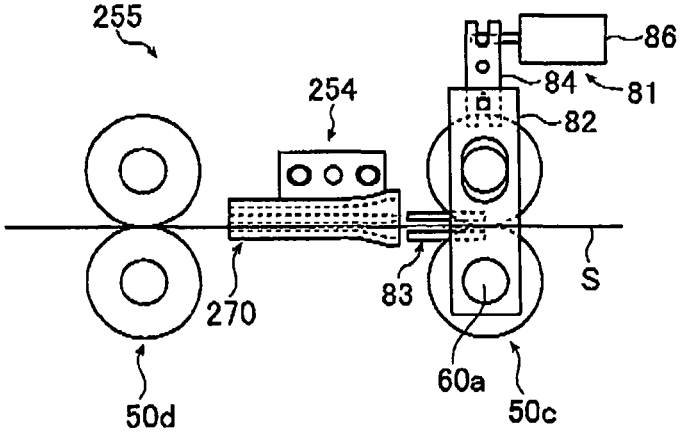
FIGS. 19A and 19B are each a schematic view for illustrating the operation of the regulating guide unit shown in FIGS. 15A through 15C.

As shown in FIG. 15B and FIG. 19A, in the example shown, in the normal state (i.e., the state in which the piston 86*a* has not been extruded yet), the fixed guide 268 and the variable-width guides 270 and 272 are arranged such that the parallel path (i.e., the lower transport path where the fixed guide 268 is used) constitutes the transport path where the recording sheets S are transported by the roller transport pairs 50*c* and 50*d*.

Thus, as shown in FIG. 19A, the leading guide 83 which is formed of guide plates parallel to the transport paths where transport is effected by the transport roller pair 50*c* is in the state in which the leading guide 83 guides the recording sheets S into the parallel path. The recording sheets S transported from the transport roller pair 50*c* are guided by the leading guide 83 and pass through the lower parallel path of the regulating guide 254 (formed by fixed guide 268 and variable-width guides 270 and 272) to be regulated in their positions in the width direction, and are further fed to the transport roller pair 50*d* before being transported to the recording unit 56 (i.e., the reference guide 102 thereof) on the downstream side.

Figure 19B:
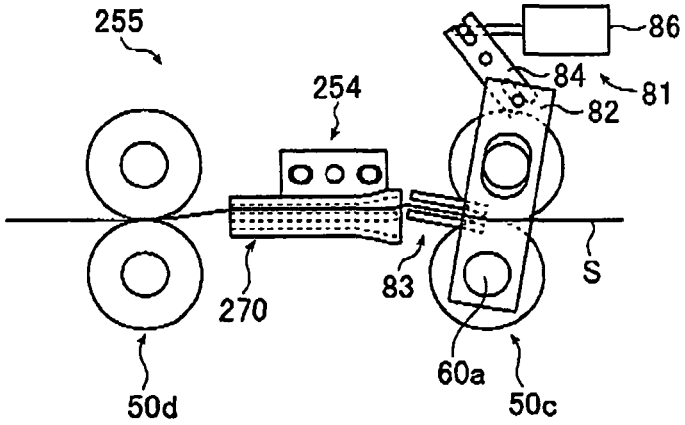

As shown in FIG. 19B, when, in this normal state, the solenoid 86 extrudes the piston 86*a*, the piston 86*a* pushes the upper portion of the lever 84 toward the downstream side. As described above, the lever 84 is swingably supported at the center by the pin 84*c*, so the lever 84 is inclined through this pushing by the piston 86*a*, with its upper portion being on the downstream side and its lower portion on the upstream side.

Due to this inclination of the lever 84, the pin 82*c* on the upper portion of the bracket 82 is pushed toward the upstream side. As stated above, the bracket 82 rotatably supports the driven roller 62, and is rotatably supported by the driving roller 60 (i.e., the rotation shaft 60*a*), so the bracket 82 is inclined about the driving roller 60 through this pushing with its upper portion being directed to the upstream side. As shown in FIG. 19B, as a result of this inclination of the bracket 82, the driven roller 62 rotatably supported by the elongated holes 82*a* moves toward the upstream side along the driving roller 60. Further, the leading guide 83 fixed to the bracket 82 is also inclined, and the transport path where transport is effected by the transport roller pair 50*c* and the leading guide 83 is shifted upwards to the upper transport path, i.e., the single-line path where the fixed guide 268 is not used.

Thus, as shown in FIG. 19B, the recording sheet S transported from the transport roller pair 50*c* in this state is guided by the leading guide 83 and passes through the upper single-line path of the regulating guide 254 (formed by the variable-width guides 270 and 272) and is regulated in its position in the width direction. Further, the recording sheet S is fed and transported to the transport roller pair 50*d* before being transported to the recording unit 56 (i.e., the reference guide 102 thereof) on the downstream side.

In order that the recording sheet S may be reliably transported from the single-line path of the regulating guide 254 to the transport roller pair 50*d*, it is possible to provide a guide member for guiding the recording sheet S from the single-line path to the transport roller pair 50*d*.

In the third aspect of the present invention also, the passage changing means for changing from the single-line path to the parallel path is not restricted to the one described above. It is also possible to use various types of other passage changing means.

Figure 20A:
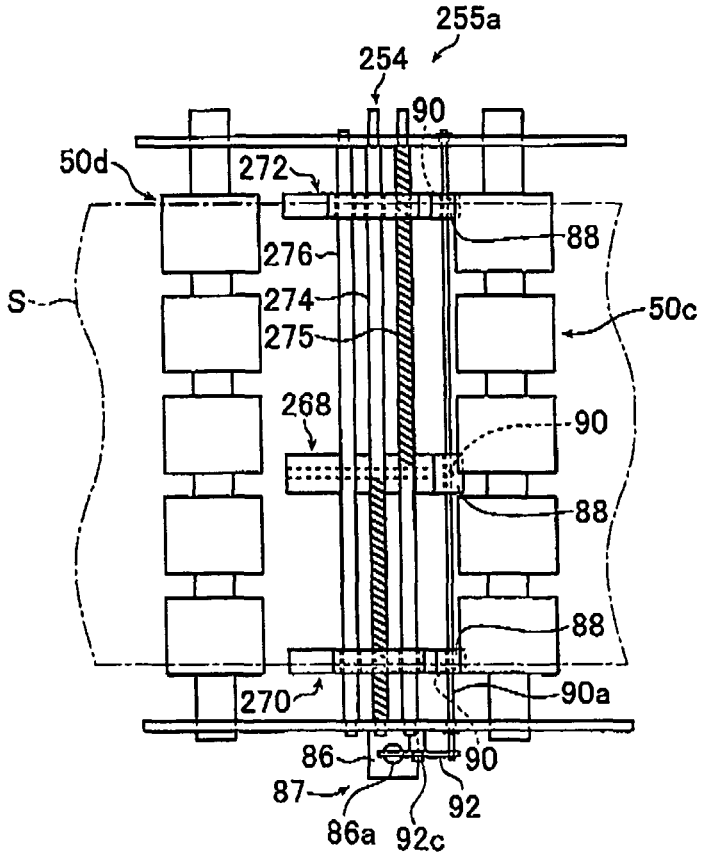
FIG. 20A is a schematic plan view showing still another embodiment of the regulating guide unit used in the image recording apparatus according to the third aspect of the present invention.
Figure 20B:
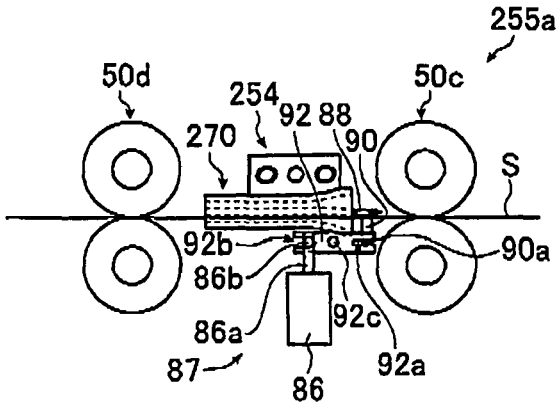
FIGS. 20B and 20C are each a front view showing a different usage pattern of the regulating guide unit shown in FIG. 20A.
Figure 20C:
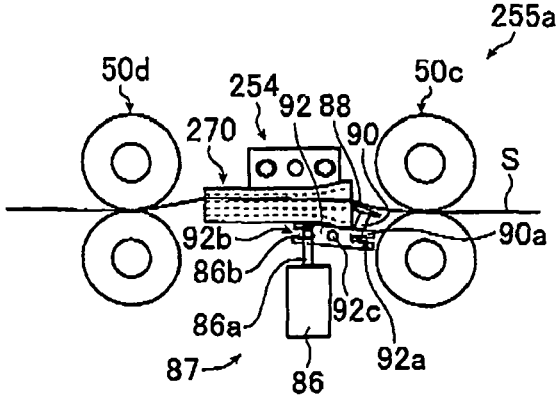

FIGS. 20A through 20C show one embodiment of the regulating guide unit 255*a* comprising another passage changing means, in which FIG. 20A is a plan view of the regulating guide unit 255*a*, and FIGS. 20B and 20C are front views thereof.

The regulating guide unit 255*a* shown in FIGS. 20A to 20C has the same configuration as the regulating guide unit 255 shown in FIGS. 15A to 15C except that the regulating guide unit 255*a* comprises the passage changing means 87 of the regulating guide unit 55*a* shown in FIGS. 6A to 6C instead of the inclination mechanism (passage changing means) 81 of the regulating guide unit 255. Thus, each component of the regulating guide unit 255*a* that is the same as that of the regulating guide unit 255 is given the same reference numeral, and the detailed explanation thereof is omitted. Therefore, different points will be mainly explained.

In the passage changing means 87 shown in FIGS. 20A through 20C, the plate-like leading guides 88 (flappers) for regulating the transport direction of the recording sheet S in the vertical direction are provided at the respective upstream ends of the fixed guide 268 and the variable-width guides 270 and 272. In this example, the transport roller pairs 50*c* and 50*d* are all rotatably supported by the frames 64*a* and 64*b*.

The leading guides 88 are of a wedge-like configuration whose thickness gradually decreases in one direction. The proximal ends (thicker ends) of the leading guides 88 are fixed to the fixed guide 268 and the variable-width guides 270 and 272 by such means as hinges, with their thinner ends (hereinafter referred to as distal ends) being on the upstream side. Thus, the leading guides can be rocked using their proximal ends as a fulcrum.

The leading guides 88 are respectively fixed to the upper portion of the upstream end portion of the fixed guide 268 and to the upstream end portions of the ribs 270*r* and 272*r* of the variable-width guides 270 and 272. That is, the leading guides 88 are fixed in position over the lower parallel path.

The plate-like arms 90 are fixed to the lower surfaces of the portions in the vicinity of the distal ends of the leading guides 88. The pin 90*a* is fixed to the lower ends of the arms 90.

As shown in FIG. 20A, the pin 90*a* fixed to the arms 90 extends in the width direction. Specifically, the single pin 90*a* passes through and is engaged with all the arms 90, that is, the arm 90 fixed to the leading guide 88 of the fixed guide 268, the arm 90 fixed to the leading guide 88 of the variable-width guide 270, and the arm 90 fixed to leading guide 88 of the variable-width guide 272, thereby fixing all the arms 90.

The solenoid 86 similar to the one described above is engaged with the downstream notch 92*b* of the lever 92. More specifically, the pin 86*b* at the distal end of the piston 86*a* of the solenoid 86 is inserted into and engaged with the downstream notch 92*b* of the lever 92.

Instead of being provided for each of the central fixed guide 268 and the variable-width guides 270 and 272, the solenoid 86 and the lever 92 are only provided one each.

Also in the example shown in FIGS. 20A through 20C, the fixed guide 268 and the variable-width guides 270 and 272 are arranged such that the transport path in which the recording sheet S are transported by the transport roller pairs 50*c* and 50*d* is matched with the parallel path (i.e., the lower transport path where the fixed guide 268 is used).

As shown in FIG. 20B, in the normal state (i.e., the state in which the piston 86*a* is not extruded), the leading guides 88 fixed in position over the lower parallel path as described above are parallel to the transport path where transport is effected by the transport roller pairs 50*c* and 50*d*. Thus, the recording sheets S transported from the transport roller pair 50*c* advance as they are to pass through the lower parallel path of the regulating guide 254 (formed by the fixed guide 268 and the variable-width guides 270 and 272) to be regulated in their positions in the width direction, and are further fed to the transport roller pair 50*d* before being transported to the recording unit 56 on the downstream side.

As shown in FIG. 20C, when, in this normal state, the solenoid 86 extrudes the piston 86*a*, the piston 86*a* upwardly pushes the downstream side of the lever 92. As stated above, the lever 92 is swingably supported at the center by the pin 92*c*, so the lever 92 is inclined through the pushing by the piston 86*a*, with the downstream side thereof being higher and the upstream side thereof lower.

As a result of this inclination of the lever 92, the arms 90 engaged with the pin 90*a* which is engaged with the notch 92*a* formed at the upstream end of the lever 92 move downwards, and the leading guides 88, with the arms 90 fixed to the lower surfaces of the portions near the distal ends thereof, are inclined with their distal ends lower, thus making the transport path shifted to the upper single-line path.

As stated above, the pin 90*a* fixing the arms 90 is engaged with all the arms 90 that are respectively fixed to the leading guides 88 of all of the fixed guide 268 and the variable-width guides 270 and 272. Thus, by driving the solenoid 86, the leading guides 88 of all of the fixed guide 268 and the variable-width guides 270 and 272 are inclined downwards.

Thus, as shown in FIG. 20C, in this state, the recording sheet S transported from the transport roller pair 50*c* is guided by the leading guides 88 and passes through the upper single-line transport path of the regulating guide 254 (formed by the variable-width guides 270 and 272) to be regulated in its position in the width direction and is further fed and transported to the transport roller pair 50*d* before being transported to the recording unit 56 (i.e., the reference guide 102 thereof) on the downstream side.

In the example shown, although the fixed guide 268 and the variable-width guides 270 and 272 are arranged such that the transport path where transport is effected by the transport roller pairs 50*c* and 50*d* is matched with the parallel path for the parallel transport, this should not be construed restrictively.

Taking into account the burden on the recording sheet S, it is desirable for the transport path normally used in the regulating guide 254 to be matched with the transport path where transport is effected by the transport roller pairs 50*c* and 50*d*.

Further, in the example shown, while the variable-width guides 270 and 272 (outer guides) which are provided outwardly in the width direction are provided with two passage portions arranged in the vertical direction, and two transport paths are provided in the vertical direction, this should not be construed restrictively. For example, it is also possible to provide three transport paths in the vertical direction.

For example, it is also possible to adopt a construction in which three passage portions are vertically arranged in each of the variable-width guides 270 and 272 and in which two second inner guides having on both sides in the width direction thereof passage portions for the recording sheet S are provided at positions which are between the fixed guide 268 (inner guide) and the variable-width guides in the width direction and which do not interfere with the transport plane of the fixed guide 268, whereby it is possible to perform the parallel transport in three lines. Due to this construction, it is possible to perform three modes of transport. The three modes of transport include the single-line transport using solely the variable-width guides 270 and 272, the parallel transport in two lines using the fixed guide 268, and the parallel transport in three lines using the two second inner guides.

It is also possible for at least one of the above two second inner guides to be movable in the width direction.

As is apparent from the above description, according to the third aspect of the present invention, in the regulating guide for regulating the positions in the width direction of the recording sheet S, the pair of outer guides are continuously movable in the width direction independently of each other in the width direction with respect to the inner guide fixed at a predetermined position therebetween, so the width of the parallel path and that of the single-line path can be set arbitrarily. Thus, it is possible to handle the recording sheets S of various widths (sizes) in both the single-line transport and the parallel transport. In the case of the parallel transport, it is possible to simultaneously transport the recording sheets S of different widths in parallel. Further, by providing movement means for moving the pair of outer guides, there is no need for a user to manually move the guides, thus making it possible to easily handle the recording sheets S of various widths (sizes).

As a preferred aspect, in the regulating guide for regulating the positions in the width direction of the recording sheet S in the illustrated example, there are formed a plurality of transport paths in the vertical direction (i.e., the direction perpendicular to the transport plane for the recording sheet S), and the single-line transport and the parallel transport are performed by using these transport paths, so the regulating guide can be easily adapted to a variety of transport modes, thereby making it possible to achieve substantial improvement in degree of freedom in terms of recording modes for an image recording apparatus utilizing the parallel transport.

Similarly, in the example shown, the guide serving as a positional reference (the fixed guide 268 in the example shown) is fixed in position and does not move, so it is possible to eliminate the influence of an error in guide position attributable to such movement, that is, it is possible to perform positioning on the recording sheet S with high accuracy and to effect proper image recording free from an error in recording position, etc.

As described above, the recording unit 56 is arranged on the downstream side of the regulating guide 254 (i.e., the transport roller pair 50*d*).

The recording unit 56 comprises the well-known ink jet recording means 100 using an ink jet recording head (hereinafter referred to as recording head) and the reference guide 102 for regulating the vertical position of the recording sheet S, and performs well-known full-color image recording by ink jet.

In the regulating guide 254 of the printer 10 shown, the inner guide (the fixed guide 268 in the example shown) is fixed at a predetermined position in the width direction, and the pair of outer guides (the variable-width guides 270 and 272 in the example shown) are continuously movable in the width direction independently of each other, however, this should not be construed restrictively. For example, it is also possible to adopt a construction in which the inner guide and one outer guide are continuously movable in the width direction independently of each other and in which the other outer guide is fixed, or a construction in which all the three guide members are continuously movable in the width direction independently of each other. In brief, it is only necessary for at least two of the inner guide and the pair of outer guides to be continuously movable in the width direction independently of each other. This makes it possible to arbitrarily set the width of the transport path, so even in the case of the recording sheets S of different widths, it is possible to transport them in parallel simultaneously. Further, it is possible to handle the recording sheets S of various widths easily.

Further, while in the above example, the regulating guide 254 comprises a plurality of transport paths in the vertical direction (i.e., the direction perpendicular to the recording paper transport plane), with switching being possible between the single-line transport and the parallel transport in two or three lines or more, this should not be construed restrictively. It is also possible to adopt a construction in which only one transport path is provided in the vertical direction. In this case, it is possible for the regulating guide to be adapted solely to the parallel transport as in Patent Document 1 or to be adapted to both the parallel transport and the single-line transport, with the inner guide being vertically movable as in Patent Document 2.

Although the image recording apparatus of the present invention has been explained in detail above, the present invention is not limited to the above embodiments, and various modifications and improvements are of course possible without departing from the gist of the present invention.

What is claimed is:

1. An image recording apparatus, comprising:

an image recording section for recording an image on a recording medium;

a loading section for loading said recording medium;

feeding means for feeding said recording medium from said loading section to said image recording section;

a discharging section for discharging said recording medium on which said image has been recorded in said image recording section;

transport means for transporting said recording medium from said loading section to said discharging section;

a regulating guide which is arranged in a transport path for said recording medium transported by said transport means from said loading section to said discharging section and which regulates a position of said recording medium in a width direction perpendicular to a transport direction of said recording medium transported by said transport means, wherein said regulating guide has:

a pair of outer guides arranged at outermost positions in said width direction and having in a direction perpendicular to a transport plane for said recording medium plural outer passage portions for regulating a position of one end portion of said recording medium in said width direction, and at least one inner guide arranged between said pair of outer guides and having on both sides in said width direction inner passage portions for regulating a position of another end portion of said recording medium in said width direction at a position in said direction perpendicular to said transport plane for said recording medium corresponding to one outer passage portion of said pair of outer guides, and wherein said regulating guide forms plural passages in said direction perpendicular to said transport plane for said recording medium, said plural passages including:

a first passage formed by two corresponding outer passage portions of said pair of outer guides, and at least one second passage formed by the other one outer passage portion of one of said pair of outer guides and one of said inner passage portions of said at least one inner guide corresponding to the other one outer passage portion; and passage changing means for regulating said transport direction of said recording medium in said direction perpendicular to said transport plane for said recording medium and changing said first passage and one of said at least one second passage to guide said recording medium to a changed passage, wherein said passage changing means comprises:

a roller pair arranged immediately upstream said regulating guide, for transporting said recording medium in a nipping state;

a leading guide provided integrally with said roller pair, for regulating said recording medium to guide said recording medium into one of said plural passages for said recording medium in said direction perpendicular to said transport plane for said recording medium; and rocking means for rocking said roller pair and said leading guide.

2. The image recording apparatus according to claim 1, further comprising:

first movement means for moving said pair of outer guides in said width direction of said transport path for said recording medium, respectively, wherein said pair of outer guides are movable in said width direction.

3. The image recording apparatus according to claim 1, wherein said at least one inner guide is fixed in position.

4. The image recording apparatus according to claim 1, wherein each of said pair of outer guides has two outer passage portions, and said at least one inner guide is an inner guide having an inner passage portion corresponding to one of said two outer passage portions.

5. The image recording apparatus according to claim 1, wherein said passage changing means regulates a leading end of said recording medium in said direction perpendicular to said transport plane for said recording medium and guides said leading end of said recording medium into said changed passage.

6. An image recording apparatus, comprising:

an image recording section for recording an image on a recording medium;

a loading section for loading said recording medium;

feeding means for feeding said recording medium from said loading section to said image recording section;

a discharging section for discharging said recording medium on which said image has been recorded in said image recording section;

transport means for transporting said recording medium from said loading section to said discharging section;

a regulating guide which is arranged in a transport path for said recording medium transported by said transport means from said loading section to said discharging section and which regulates a position of said recording medium in a width direction perpendicular to a transport direction of said recording medium transported by said transport means, wherein said regulating guide has:

a pair of outer guides arranged at outermost positions in said width direction and having in a direction perpendicular to a transport plane for said recording medium plural outer passage portions for regulating a position of one end portion of said recording medium in said width direction, and at least one inner guide arranged between said pair of outer guides and having on both sides in said width direction inner passage portions for regulating a position of another end portion of said recording medium in said width direction at a position in said direction perpendicular to said transport plane for said recording medium corresponding to one outer passage portion of said pair of outer guides, and wherein said regulating guide forms plural passages in said direction perpendicular to said transport plane for said recording medium, said plural passages including:

a first passage formed by two corresponding outer passage portions of said pair of outer guides, and at least one second passage formed by the other one outer passage portion of one of said pair of outer guides and one of said inner passage portions of said at least one inner guide corresponding to the other one outer passage portion; and passage changing means for regulating said transport direction of said recording medium in said direction perpendicular to said transport plane for said recording medium and changing said first passage and one of said at least one second passage to guide said recording medium to a changed passage, wherein said passage changing means comprises:

a leading guide which is provided on upstream end portions of said pair of outer guides and said at least one inner guide and which rocks said upstream end portions in said direction perpendicular to said transport plane for said recording medium using said pair of outer guides and/or said at least one inner guide as a fulcrum.

7. An image recording apparatus, comprising:

an image recording section for recording an image on a recording medium;

a loading section for loading said recording medium;

feeding means for feeding said recording medium from said loading section to said image recording section;

a discharging section for discharging said recording medium on which said image has been recorded in said image recording section;

transport means for transporting said recording medium from said loading section to said discharging section;

a regulating guide which is arranged in a transport path for said recording medium transported by said transport means from said loading section to said discharging section and which regulates a position of said recording medium in a width direction perpendicular to a transport direction of said recording medium transported by said transport means, wherein said regulating guide has:

a pair of outer guides arranged at outermost positions in said width direction and having in a direction perpendicular to a transport plane for said recording medium two outer passage portions for regulating a position of one end portion of said recording medium in said width direction, and a pair of inner guides arranged between said pair of outer guides and having in said width direction an inner passage portion for regulating a position of another end portion of said recording medium in said width direction at a position in said direction perpendicular to said transport plane for said recording medium corresponding to one outer passage portion of said pair of outer guides, and wherein said regulating guide forms plural passages in said direction perpendicular to said transport plane for said recording medium, said plural passages including:

a first passage that is formed by two corresponding outer passage portions of said pair of outer guides, and a second passage that is formed by the other one outer passage portion of one of said pair of outer guides and said inner passage portion of one of said pair of inner guides corresponding to the other one outer passage portion;

first movement means for moving said pair of outer guides to arrange said pair of outer guides at symmetrical positions with respect to a central position of said first passage for said recording medium in said width direction;

second movement means for moving said pair of inner guides to arrange said pair of inner guides at symmetrical positions with respect to said central position; and passage changing means for regulating said transport direction of said recording medium in said direction perpendicular to said transport plane for said recording medium and changing said first passage and said second passage to guide said recording medium to a changed passage.

8. The image recording apparatus according to claim 7, wherein said pair of inner guides have second inner passage portions on sides opposed to each other in said width direction.

9. The image recording apparatus according to claim 7, wherein said recording section comprises a line head with recording elements arranged over a length including a maximum recording width in said width direction and performs image recording on said recording medium by said line head, and wherein said image recording apparatus further comprises:

storage means for storing a number of times that each recording element of said line head is driven; and control means for driving said first movement means and said second movement means according to said number of times of driving stored in said storage means to determine said position of said regulating member.

10. An image recording apparatus, comprising:

an image recording section for recording an image on a recording medium;

a loading section for loading said recording medium;

feeding means for feeding said recording medium from said loading section to said image recording section;

a discharging section for discharging said recording medium on which said image has been recorded in said image recording section;

transport means for transporting said recording medium from said loading section to said discharging section;

a regulating guide which is arranged in a transport path for said recording medium transported by said transport means from said loading section to said discharging section and which regulates a position of said recording medium in a width direction perpendicular to a transport direction of said recording medium transported by said transport means, wherein said regulating guide has:

a pair of outer guides arranged at outermost positions in said width direction for regulating a position of one end portion of said recording medium in said width direction, and at least one inner guide arranged between said pair of outer guides and having on both sides in said width direction guide portions for regulating a position of another end portion of said recording medium in said width direction; and movement means for moving at least two of said pair of outer guides and said at least one inner guide continuously in said width direction independently of each other.

11. The image recording apparatus according to claim 10, wherein said pair of outer guides have in said direction perpendicular to said transport plane for said recording medium plural outer passage portions for regulating said position of said one end portion of said recording medium in said width direction, and at least one inner guide has as said guide portions on both sides in said width direction inner passage portions for regulating said position of another end portion of said recording medium in said width direction at a position in said direction perpendicular to said transport plane for said recording medium corresponding to one outer passage portion of said pair of outer guides, wherein said regulating guide forms plural passages in said direction perpendicular to said transport plane for said recording medium, said plural passages including:

a first passage formed by two corresponding outer passage portions of said pair of outer guides; and at least one second passage formed by the other one outer passage portion of one of said pair of outer guides and one of said inner passage portions of said at least one inner guide corresponding to the other one outer passage portion, and wherein said image recording apparatus further comprises:

passage changing means for regulating said transport direction of said recording medium in said direction perpendicular to said transport plane for said recording medium and changing said first passage and one of said at least one second passage to guide said recording medium to a changed passage.

12. The image recording apparatus according to claim 11, wherein said passage changing means comprises:

a roller pair arranged immediately upstream said regulating guide, for transporting said recording medium in a nipping state;

a leading guide provided integrally with said roller pair, for regulating said recording medium to guide said recording medium into one of said plural passages for said recording medium in said direction perpendicular to said transport plane for said recording medium; and rocking means for rocking said roller pair and said leading guide.

13. The image recording apparatus according to claim 11, wherein said passage changing means comprises:

a leading guide which is provided at upstream end portions of said pair of outer guides and said at least one inner guide and which is adapted to rock said upstream end portions in said direction perpendicular to said transport plane for said recording medium using said pair of outer guides and/or said at least one inner guide as a fulcrum.

14. The image recording apparatus according to claim 11, wherein said movement means moves at least said pair of outer guides independently of each other and continuously in said width direction.

* * * * *